US008474194B2

(12) United States Patent
Tiramani

(10) Patent No.: US 8,474,194 B2
(45) Date of Patent: Jul. 2, 2013

(54) MODULAR PREFABRICATED HOUSE

(75) Inventor: Paolo Tiramani, Greenwich, CT (US)

(73) Assignee: 500 Group Inc., Stamford, CT (US)

( * ) Notice: Subject to any disclaimer, the term of this patent is extended or adjusted under 35 U.S.C. 154(b) by 1824 days.

(21) Appl. No.: 10/653,523

(22) Filed: Sep. 2, 2003

(65) Prior Publication Data

US 2006/0059792 A1 Mar. 23, 2006

Related U.S. Application Data

(60) Provisional application No. 60/407,046, filed on Aug. 30, 2002.

(51) Int. Cl.
*E04B 1/343* (2006.01)
*E04B 1/348* (2006.01)
*E04H 1/00* (2006.01)

(52) U.S. Cl.
USPC ..... 52/79.5; 52/79.8; 52/79.7; 52/71; 52/270; 52/653.1

(58) Field of Classification Search
USPC ..... 52/68–72, 79.2, 79.5, 79.7, 79.9, 52/79.12, 79.8, 270, 285.1–285.4, 653.1
See application file for complete search history.

(56) References Cited

U.S. PATENT DOCUMENTS

| | | | | | |
|---|---|---|---|---|---|
| 2,070,924 | A | * | 2/1937 | Derman | 312/260 |
| 2,644,203 | A | * | 7/1953 | Donahue | 52/34 |
| 3,550,334 | A | * | 12/1970 | Van Der Lely | 52/79.7 |
| 3,611,659 | A | * | 10/1971 | Greenlaugh | 52/79.12 |
| 3,694,977 | A | * | 10/1972 | Verman | 52/79.7 |
| 3,712,007 | A | * | 1/1973 | Kump | 52/79.12 |
| 3,720,022 | A | * | 3/1973 | Dattner | 52/79.7 |
| 3,750,366 | A | * | 8/1973 | Rich et al. | 52/79.11 |
| 3,793,796 | A | * | 2/1974 | Hughes | 52/79.8 |
| RE28,367 | E | * | 3/1975 | Rich, Jr. et al. | 52/79.11 |
| 4,155,204 | A | | 5/1979 | Prozinski | |
| 4,441,286 | A | * | 4/1984 | Skvaril | 52/79.1 |
| 4,464,877 | A | * | 8/1984 | Gebhardt et al. | 52/745.02 |
| 4,599,829 | A | * | 7/1986 | DiMartino, Sr. | 52/79.7 |
| 4,635,412 | A | | 1/1987 | Le Poittevin | |
| 4,644,708 | A | * | 2/1987 | Baudot et al. | 52/79.9 |
| 4,766,708 | A | * | 8/1988 | Sing | 52/167.8 |
| 4,779,514 | A | * | 10/1988 | Prigmore et al. | 52/79.5 |
| 4,780,996 | A | | 11/1988 | Julien, Jr. | |
| 4,958,874 | A | * | 9/1990 | Hegedus | 296/26.02 |
| 4,958,974 | A | * | 9/1990 | Schenk | 412/37 |
| 5,070,667 | A | * | 12/1991 | Schulte | 52/241 |
| 5,596,844 | A | | 1/1997 | Kalinowski | |
| 5,755,063 | A | * | 5/1998 | Ohnishi et al. | 52/79.8 |
| 5,950,373 | A | | 9/1999 | von Hoff et al. | |
| 6,625,937 | B1 | * | 9/2003 | Parker et al. | 52/79.7 |
| 6,925,761 | B1 | * | 8/2005 | De La Marche | 52/79.7 |
| 6,959,514 | B1 | * | 11/2005 | Pingel | 52/79.1 |
| 6,959,515 | B1 | * | 11/2005 | Beighton | 52/79.9 |
| 6,983,567 | B2 | * | 1/2006 | Ciotti | 52/79.5 |

FOREIGN PATENT DOCUMENTS

| | | |
|---|---|---|
| WO | WO 86/04630 | 8/1986 |

* cited by examiner

*Primary Examiner* — Jeanette E. Chapman
(74) *Attorney, Agent, or Firm* — Eckert Seamans Cherin & Mellott, LLC; David C. Jenkins

(57) ABSTRACT

A prefabricated house including two or more modules, each module having one or more foldable walls. The foldable walls have one or more multi-frame openings. The two or more modules are structured to be joined at one of the one or more multiframe openings.

4 Claims, 20 Drawing Sheets

80
82

20

80
18

80

11
3A
80
90
11

90
90

32
31
11
35

90
80
11
7

11

11

11

MODULAR PREFABRICATED HOUSE

CROSS-REFERENCE TO RELATED APPLICATION

This application claims priority under 35 U.S.C. §119(e) to provisional application Ser. No. 60/407,046, filed Aug. 30, 2002, which is incorporated by reference, and is related to commonly assigned concurrently filed U.S. patent application Ser. No. 60/407,022, filed Aug. 30, 2002, entitled "METHOD OF SELLING PRE-FABRICATED HOUSES".

BACKGROUND OF THE INVENTION

1. Field of the Invention

This invention relates to prefabricated houses and, more specifically, to a modular, expandable prefabricated house.

2. Background Information

At least three issues are important to the prefabricated housing industry: transportation, ease of assembly, and customer choice. Presently, the market is currently broken down into several basic types of prefabricated houses. One of the largest types of prefabricated housing is modular housing. Modular housing is, typically, a two story house constructed in a factory and shipped onsite. Such houses are, typically, designed and constructed in a variety of layouts or models. These layouts, however, are only minimally adaptable by the customer. That is, while certain features, for example a closet, may be added or subtracted from a room, the general shape and layout of the house cannot be changed or adapted to the customer's preference. Such houses require substantial finish work on site involving all the trades, a foundation and significant construction time. Additionally, during transportation, modular housing requires wide load permits, state-to-state handoffs and special permits and costs.

Another form of prefabricated houses are manufactured housing, more commonly known as a double wide. A double wide generally includes components of a lower quality than modular houses and are almost always single story. A double wide, however, requires less interior finish but still requires a certain amount of finishing. The layout of a double wide is generally restricted to the prebuilt design and cannot be adapted by the customer. During transport, a double wide requires a wide load permit, state-to-state handoffs, and special permits and costs.

Similar to a double wide is trailer homes. Trailer homes are complete houses which require very little, if any finishing. The layout of a trailer house is generally restricted to the prebuilt design and cannot be adapted by the customer. Trailer homes are sized to be about 60 feet×9 feet×7 feet and may be transported without wide load permits. Trailer homes are, generally, inexpensive due to their physical dimension.

Yet another form of prefabricated housing is panelized construction. Panelized construction is where house panels are finished in a factory and transported to a building site. This method of construction is often viewed as a false economy because the finishing of the house, as opposed to the framing, is typically the most expensive part of construction. Although panelizing creates semi finished walls, it leaves the floor space, appliances and closets to be finished on site mitigating many of the savings.

There are also temporary offices, or site trailers, which are similar in dimension to a trailer house. Temporary offices are typically rendered in steel, and are simply a secure weatherproof location for storage, office and meeting areas as well as a communication receiver for telephone/fax and/or a computer network.

There are also temporary shelters made from a variety of very low cost products which can be static or folding in a variety of novel ways. Temporary shelters are best differentiated from houses by their lack of smart space, i.e., closets kitchens, bathroom or anything that requires floor space, as this does not lend itself to being packed flat. Such shelters are, almost without exception, single story.

There is, therefore, a need for a modular prefabricated house which may be adapted to a customer selected layout.

There is a further need for a modular prefabricated house which may be collapsed into one or more modules which may be transported without legal restrictions.

There is a further need for a modular prefabricated house that includes a plurality of multi-frame openings that may be adapted to a customer selected layout and which enable the modules to be coupled in more than one layout.

SUMMARY OF THE INVENTION

These needs, and others, are met by the disclosed invention which provides a prefabricated house having two or more modules, each module having one or more foldable walls. The foldable walls have one or more multi-frame openings that may be converted to doors, windows or other openings. Thus, the individual modules are structured to be joined at the multi-frame openings in more than one configuration. For example, if each module was rectangular and included a multi-frame opening at the middle point of each wall, the modules could be joined along adjacent longitudinal walls thereby forming, generally, a square shaped layout, or, the modules could be joined with a longitudinal wall coupled to a lateral wall, thereby forming, generally, a T-shaped layout.

The multi-frame openings are disposed at set distances regardless of the shape of the module. Thus, modules of different shapes may be joined as the multi-frame openings will be spaced properly. Additionally, there may be more than one opening between modules. For example, two rectangular modules, each having a plurality of multi-frame openings along the longitudinal wall, may be joined by doors at each end of the joined longitudinal wall.

The multi-frame openings are created as part of the frame during the construction of the module. The multi-frame openings may then be covered, for example, by dry wall. During construction of the house, the covering is removed at each multi-frame opening where modules need to be joined. Alternatively, if the layout of the house is known, the multi-frame openings may be converted to the proper type of aperture, that is doors, windows, and such, during construction of the module. However, if during construction of the house the customer desires a new window or door, a multi-frame opening may also be converted to an aperture at the construction site. Because each type of module is manufactured in an identical manner, regardless of where the apertures will be disposed, manufacturing costs are reduced. However, because each type of module includes a plurality of multi-frame openings, each module is still adaptable to the layout chosen by the customer.

The invention is suitable for providing houses at the top end of the portable housing market, that is, comparable to modular housing, without the inherent drawbacks of modular housing. That is, each module is substantially finished and each module, when the foldable walls are folded, has dimensions of less than about 66 feet, by 10 feet, by 12 feet. Thus, wide load, excessive shipping costs and problems which can add substantially to the cost of the house are avoided. That is, the time to transport the prior art 16 foot wide product is substantial given the speed restrictions, toll access problems and because the prior art product created such general highway congestion that the product was often forced to be transported at night by many states.

An additional mechanical novelty of the preferred embodiment described herein are the spatial and mechanical fastening relationships between the modules and accessories that create an entire building system rather than a single product. Furthermore, each final product is produced by the system without compromise to function. Indeed, without exception, the final product is substantially improved over its traditionally built counterpart on the same cost basis.

The prior art described hereinbefore can build at best one finished style of house or temporary structure, whereas the preferred embodiment can create, the following each in an array of customer choosable floor plans, layouts and sizes.

900 square foot cottages to 4800 square foot luxury homesteads,
multi-level condo,
single and multi story motels,
entire retail towns in many sizes,
temporary offices, and
temporary shelter and drop shipped 3rd-world housing.

Rather than a single product, as in the prior art, the preferred embodiment describes a series of "smart" connectable modules and accessories, inter-connectable in a multiple of configurations and details to create a multiple of end uses in a multiple of sizes and levels of finish. The formulas, spatial relationships and strict adherence to first principles in order for the system to work without compromise to acceptable cost, style, traditional and floor plan flexibility are aspects of the mechanical combinations in multiple areas as described herein.

Much of the manufactured housing, construction and shelter industry, has chosen to ignore the limitations of shipping oversize highway loads or has simply not had the resources to overcome the obstacles. It should be noted that the entirety of the preferred embodiment is shippable within standard international 60 foot high-cube (ISO) shipping containers.

BRIEF DESCRIPTION OF THE DRAWINGS

A full understanding of the invention can be gained from the following description of the preferred embodiments when read in conjunction with the accompanying drawings in which:

FIG. 9A is an isometric view of the prefabricated house in a shipping configuration on a truck. FIGS. 9B-9F are isometric views of the transition of a core module from the first, closed position to the second, open position as also shown in FIGS. 3-7. FIG. 9G is an isometric view of the core module with roof supports installed. FIGS. 9I-9J show the expansion of the roof module. FIG. 9K shows the completed prefabricated home.

DESCRIPTION OF THE PREFERRED EMBODIMENTS

Figures 1, 1A:
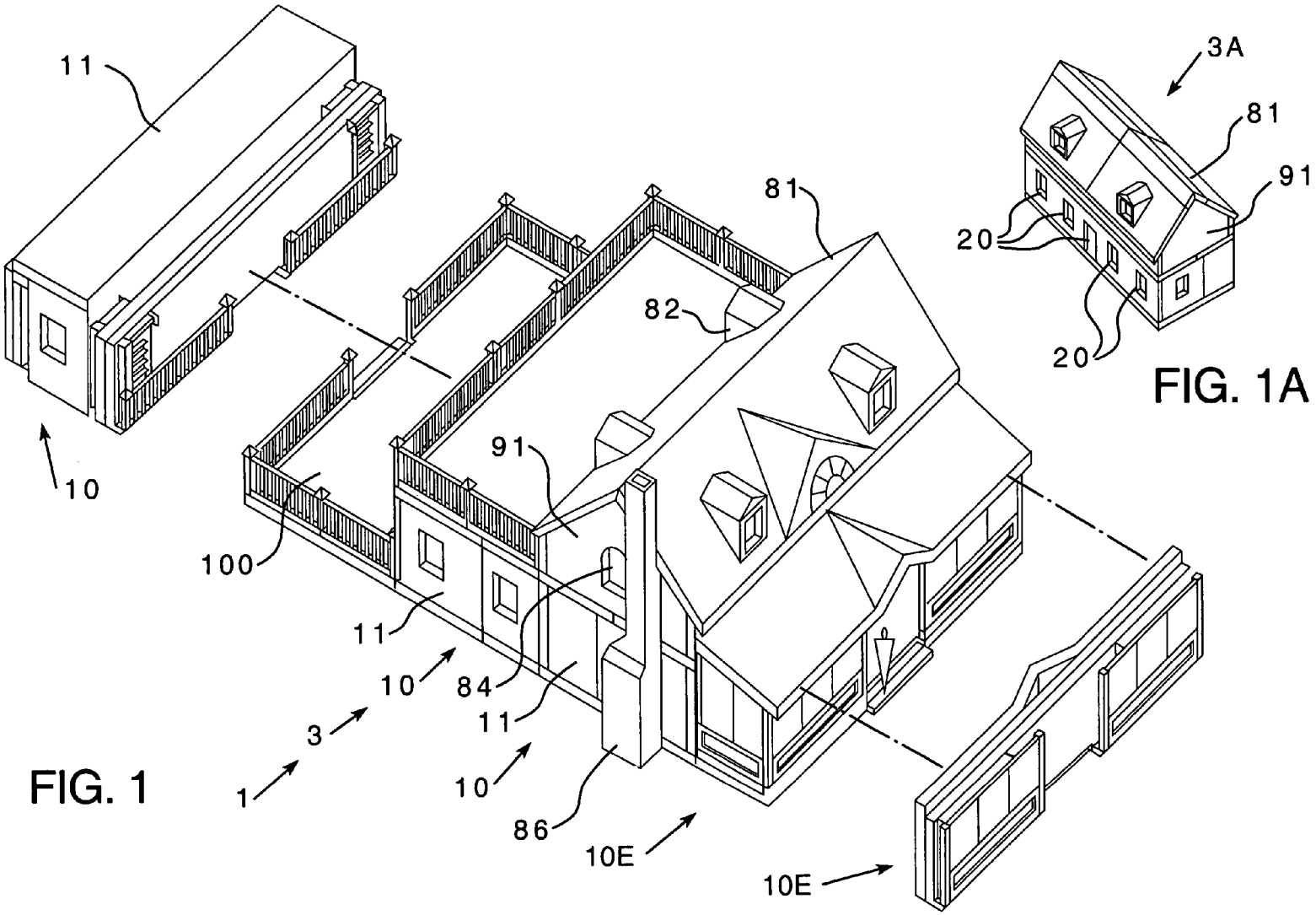
FIG. 1 is an isometric view of a modular house according to the present invention having modules shown in both the installed and uninstalled configurations.
FIG. 1A is an isometric view of a modular house according to the present invention having two modules.
Figure 2:
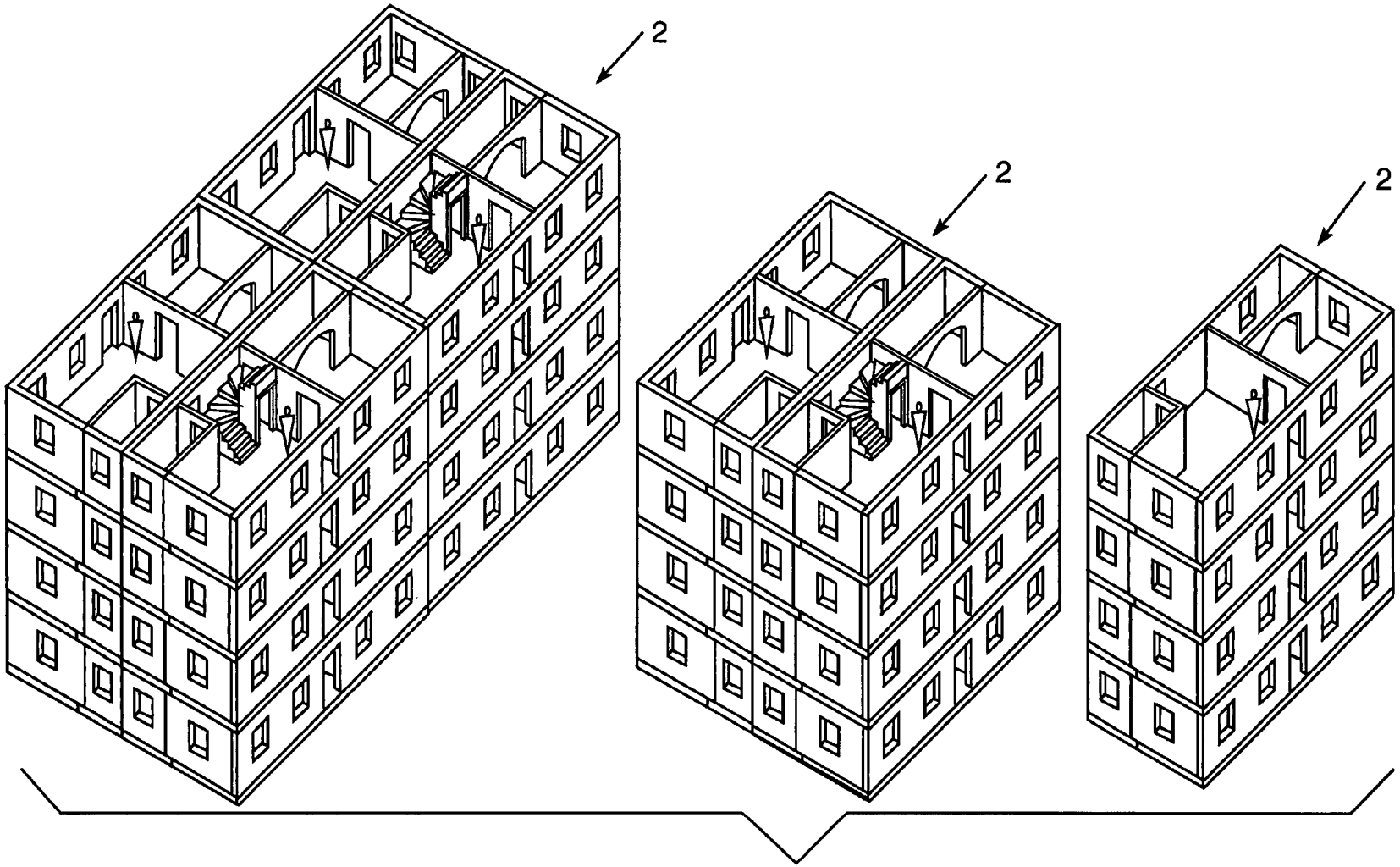
FIG. 2 is an isometric view of various multi-unit buildings formed from prefabricated modules.

As shown in FIG. 1, a prefabricated house system 1 is assembled from a series of modules 10. The prefabricated house system 1 may have as few as two modules 10 or include a plurality of joined modules 10. As such, the prefabricated house system 1 may be used to construct a prefabricated house 3. The prefabricated house 3 may be any size, such as the smaller prefabricated house 3A shown in FIG. 1A, or a larger prefabricated house 3, as shown in FIG. 1. Alternatively, as shown in FIG. 2, the same modules 10 may be used to construct a multi-level condo 2, single and multi story motels (not shown), retail buildings, temporary offices, or temporary shelter. The preferred embodiment is component driven, i.e., each module 10 is one of several modules 10 to complete the prefabricated house 3 not a finished product in and to itself. Moreover, as described below, the modules are factory built and shippable within standard international container (ISO) dimensions, nationwide and worldwide.

The prefabricated house system 1 includes mathematically interrelated modules 10 and accessories that are configurable to create hundreds of affordable floor plans and layouts to meet a user's needs. As described below, the prefabricated house system 1 includes modules 10 having ports 5 located at set locations with hidden multi-frame openings 20. The multi-frame openings 20 allow users to upgrade their house using hand tools to add complete second stories, or simple additions such as dormers or a fireplace.

Figure 3:
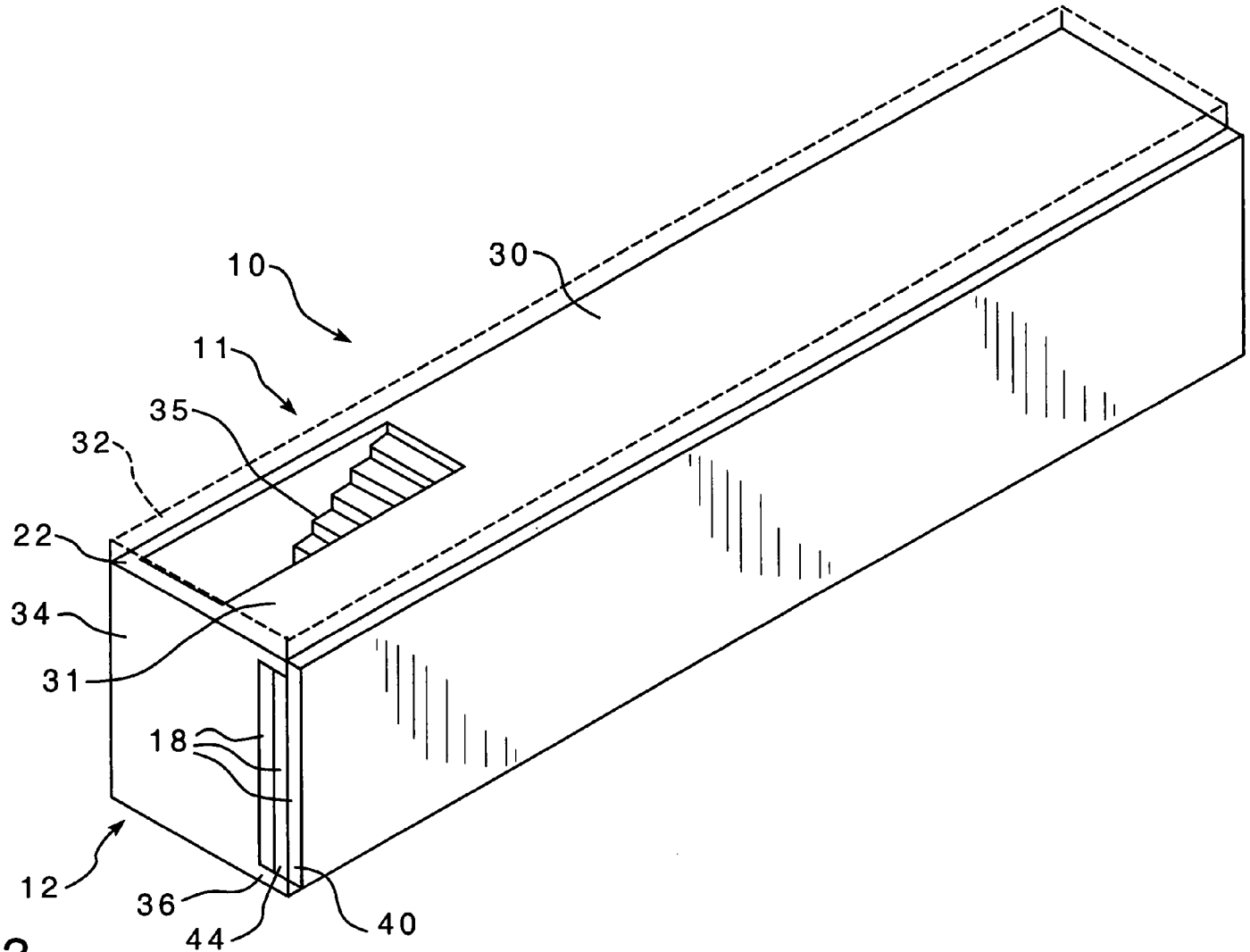
FIG. 3 is an isometric view of a module in the first, closed position.
Figure 4:
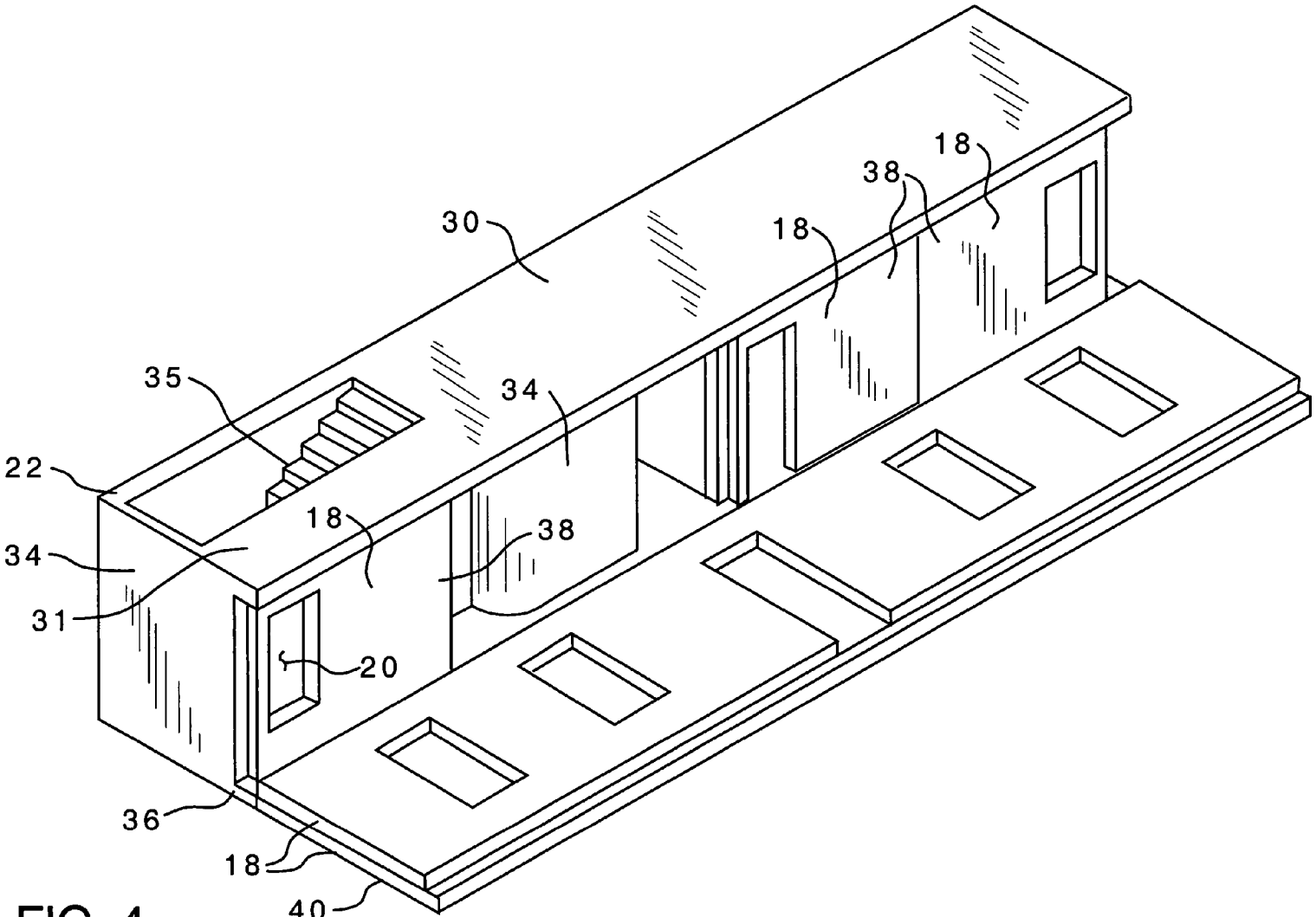
FIG. 4 is an isometric view of a module in between the first, closed position and the second, open position.
Figure 5:
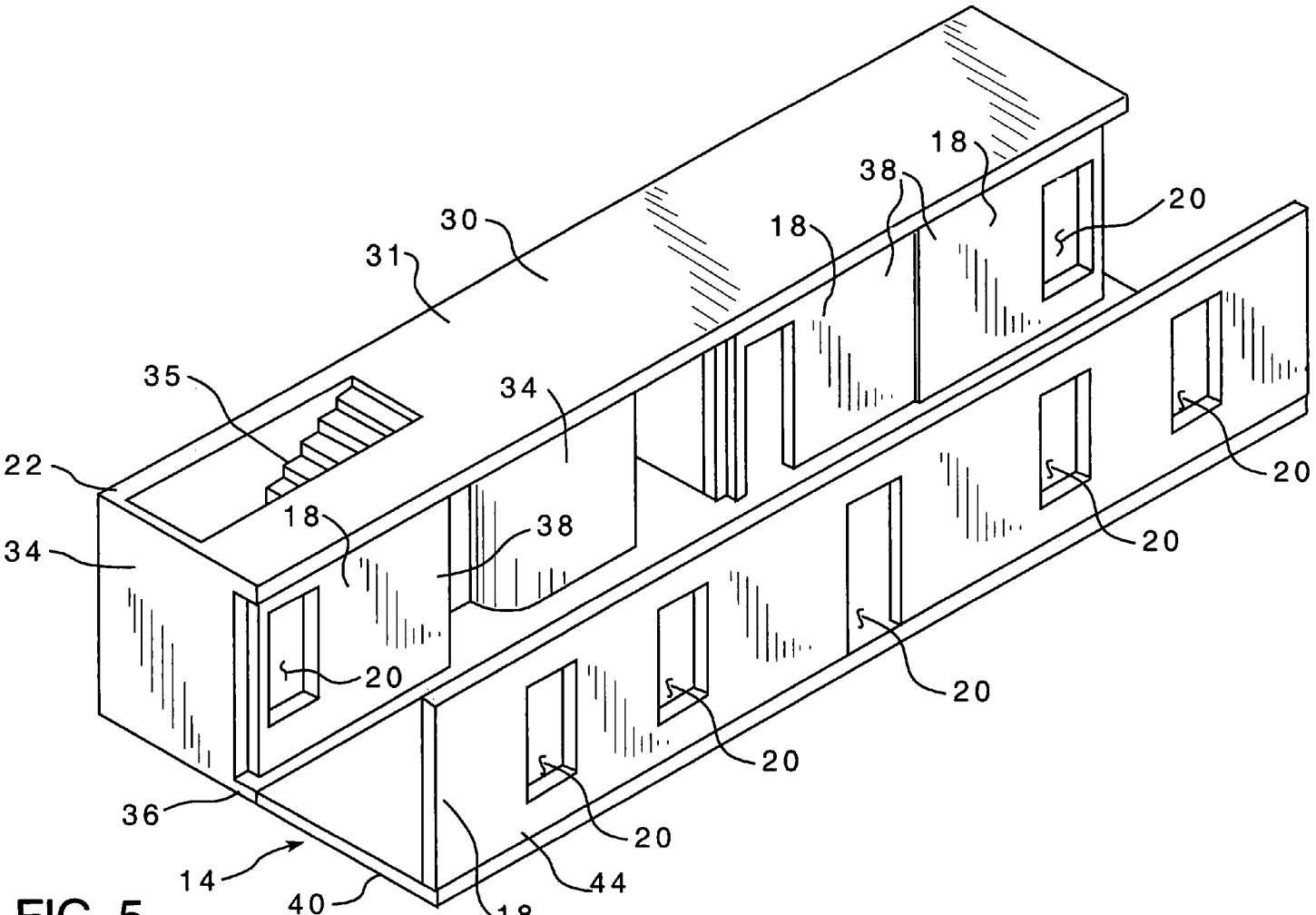
FIG. 5 is an isometric view of a module in between the first, closed position and the second, open position.
Figure 6:
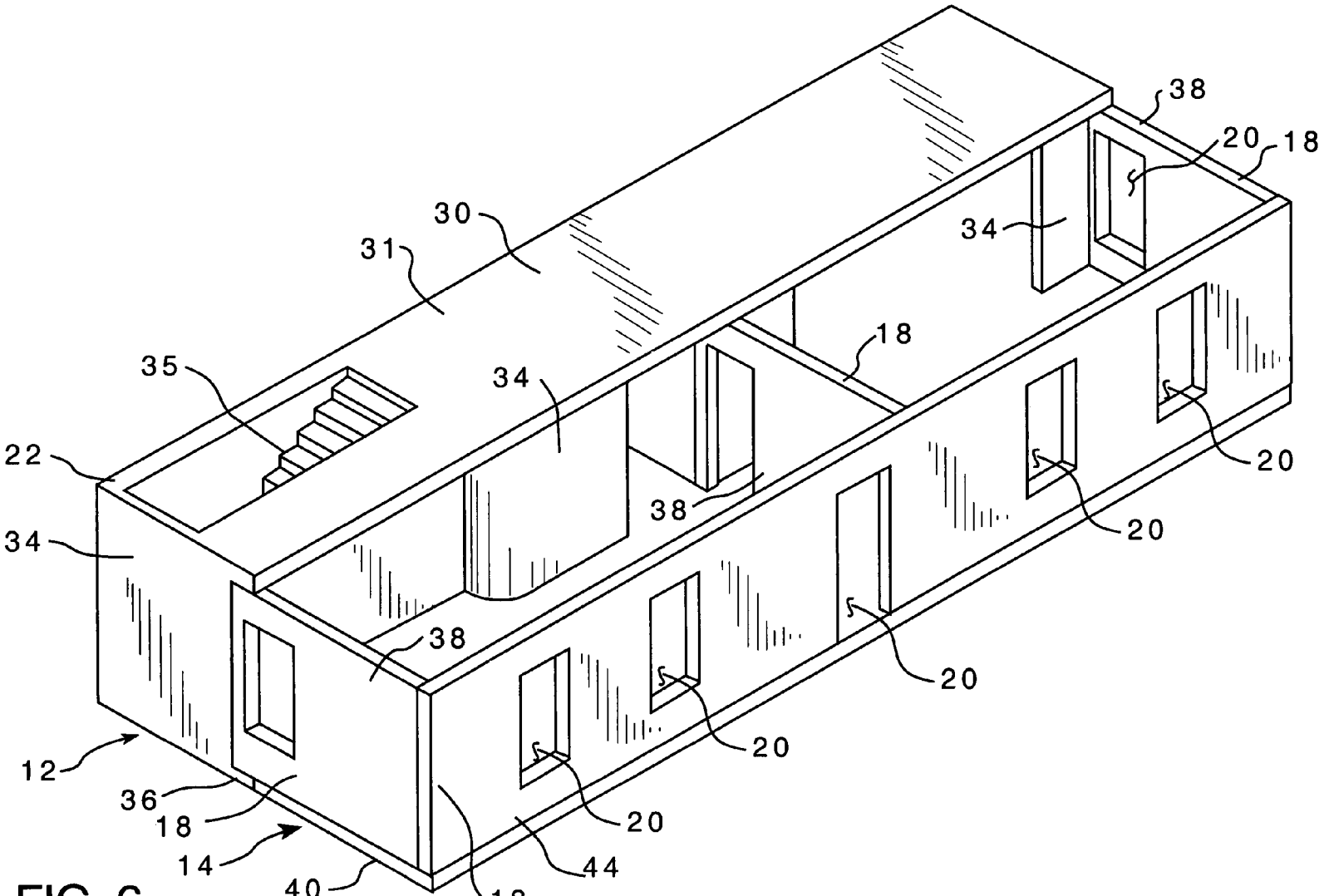
FIG. 6 is an isometric view of a module in between the first, closed position and the second, open position.

As shown in FIGS. 1-6, a prefabricated house 3 includes two or more modules 10, each module 10 having one or more foldable panels 18. The foldable panels 18 have one or more multi-frame openings 20, described below. The two or more modules 10 are structured to be joined at the one or more multi-frame openings 20. At least one of the two or more modules 10 is a core module 11 having a fixed space portion 12 and a passive space portion 14, discussed below (FIGS. 4-5). The fixed space portion 12 has non-foldable walls 16; the passive space portion 14 includes the foldable panels 18. The foldable panels 18 are movable from a first, closed position to second open position. When the foldable panels 18 of a module 10 are in the first, folded position, as shown in FIG. 3, the module 10 has dimensions of less than about 66 feet, by 10 feet, by 12 feet, which, as shown in FIG. 6, is sized to be shipped by a truck 7. Each of the modules 10 includes substantially finished trim.

Core modules 11 (FIGS. 1-6) are sized to standard international container sizes (ISO). The value of this is standardized worldwide shipping, the preferred embodiments come in two basic core sizes, one with an outside height dimension of 10 foot for (ISO) standard and a second size of 11 foot for national shipping. The difference in the two sizes is the height of the internal ceiling in the completed prefabricated house 3. That is, the former ISO sized module yields an eight-foot ceiling, the national sized module, a nine-foot ceiling. The outside dimension of all core modules 11 therefore fall within the following parameters height from about 9 feet to 12 feet, width from about 5 feet to 10 feet length from 20 feet to 66 feet.

The core modules 11 are a series of connectable modules 10 which are, generally, indoor rooms such as, but not limited to, bedrooms, bathrooms, recreation rooms, study, living rooms, dining rooms, play rooms, libraries, kitchens, laundry rooms, single garages, double garages, triple garages, great rooms, artist's studios, offices, and storage rooms. This is compared to the broader category of modules 10 that may further include, but is not limited to, decks, porches, and other outdoor structures.

As noted above, each core module 11 includes a fixed space portion 12 and a passive space portion 14. Fixed space does not compress. That is, fixed space is rigid and does not include foldable panels 18. Fixed space is typically any space that has functionality beyond providing volume. For example, the following would qualify as fixed space: closets, bathrooms, kitchens, storages, laundry rooms or house mechanical space, as well as corridors and stairs. Conversely, passive space is compressible space, i.e., that which may be folded. Typically, the passive space is not laden with fixtures, etc. The foldable panels 18 of the core module 11 may be folded into the passive space portion 14 when the core module 11 is in the shipping configuration. Fixed and passive space is achieved by a mechanical opening of foldable panels 18. As used herein, "foldable panels 18" are typically walls, but may also include other foldable components such as, but not limited to, foldable decks, ceilings, dividers, or roofs.

Each core module 11 includes a plurality of connection points, each of which is a multi-frame opening 20. The multi-frame openings 20 are built into the module frame 22 during construction, but may be disposed under a covering 19 over the frame 22, such as dry wall. The multi-frame openings 20 on separate core modules 11 are disposed in predetermined locations so that multiple core modules 11 may be joined together when the modules are aligned in various predetermined configurations. Thus, when core modules 11 are joined together, any pair of multi-frame openings 20 may have the covering 19 removed so that a passageway is formed. Other multi-frame openings 20 may be converted into windows or other such openings. Construction of the multi-frame opening 20 may be traditional or steel framed or a combination or hybrid, including wood, steel, plastics, adhesives, screws, nails, chalkboard, vinyl's glass, rubber and/or not limited to other synthetics.

Figure 1B:
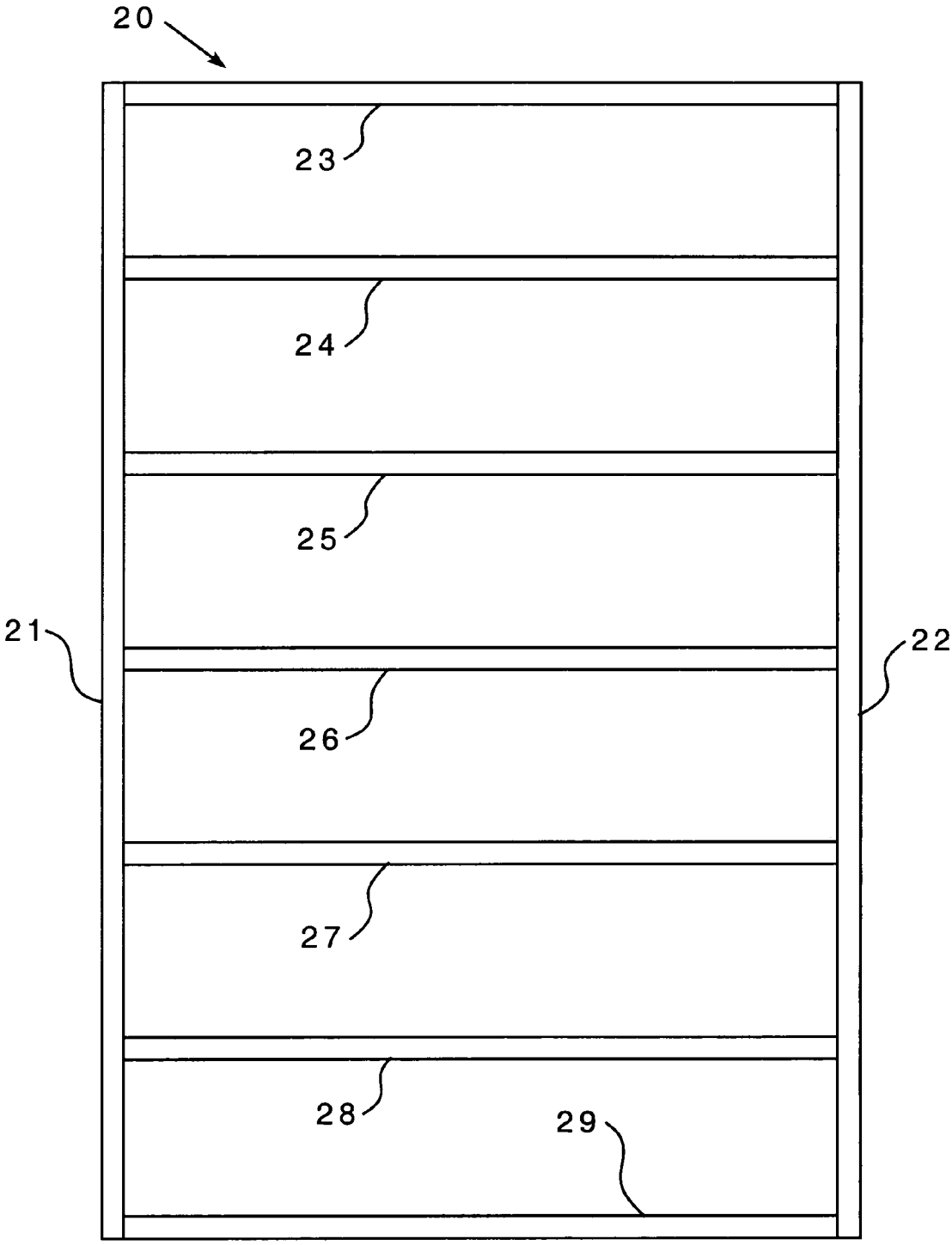
FIG. 1B is a front view of a multi-frame opening.

A multi-frame opening 20 is shown in FIG. 1B. The multi-frame opening 20 may be disposed between any two spaced apart studs 21, 21A within the frame 22, and incorporates the studs 21, 21A into the multi-frame opening 20. The multi-frame opening 20 also includes a plurality of cross members 23, 24, 25, 26, 27, 28, 29. Two of the cross members, at the top and bottom 23, 29, may be integral with the module frame 22. The top and bottom cross-members 23, 29 along with the medial cross-members 24, 25, 26, 27, 28 are removably coupled to the studs 21, 21A and may be removed as required to construct the appropriate sized openings. For example, if the opening is to be a door, the medial and bottom cross-members 24, 25, 26, 27, 28, 29 could be removed. If the opening is to be a window, the upper cross-members 24, 25, and 26 may be removed. If the opening is to be a fireplace, the lower cross-members 26, 27, 28 may be removed. Any cross-member 23, 24, 25, 26, 27, 28, 29 that is left in place is coupled to the studs 21, 21A in a manner known in the prior art sufficient to support any additional component, for example, but not limited to, a window frame or fireplace insert. The actual number of cross-members may vary between and within a prefabricated house system 1. That is, as shown, there are seven cross-members 23, 24, 25, 26, 27, 28, 29. There may, however, be additional or fewer cross-members.

Figure 7:
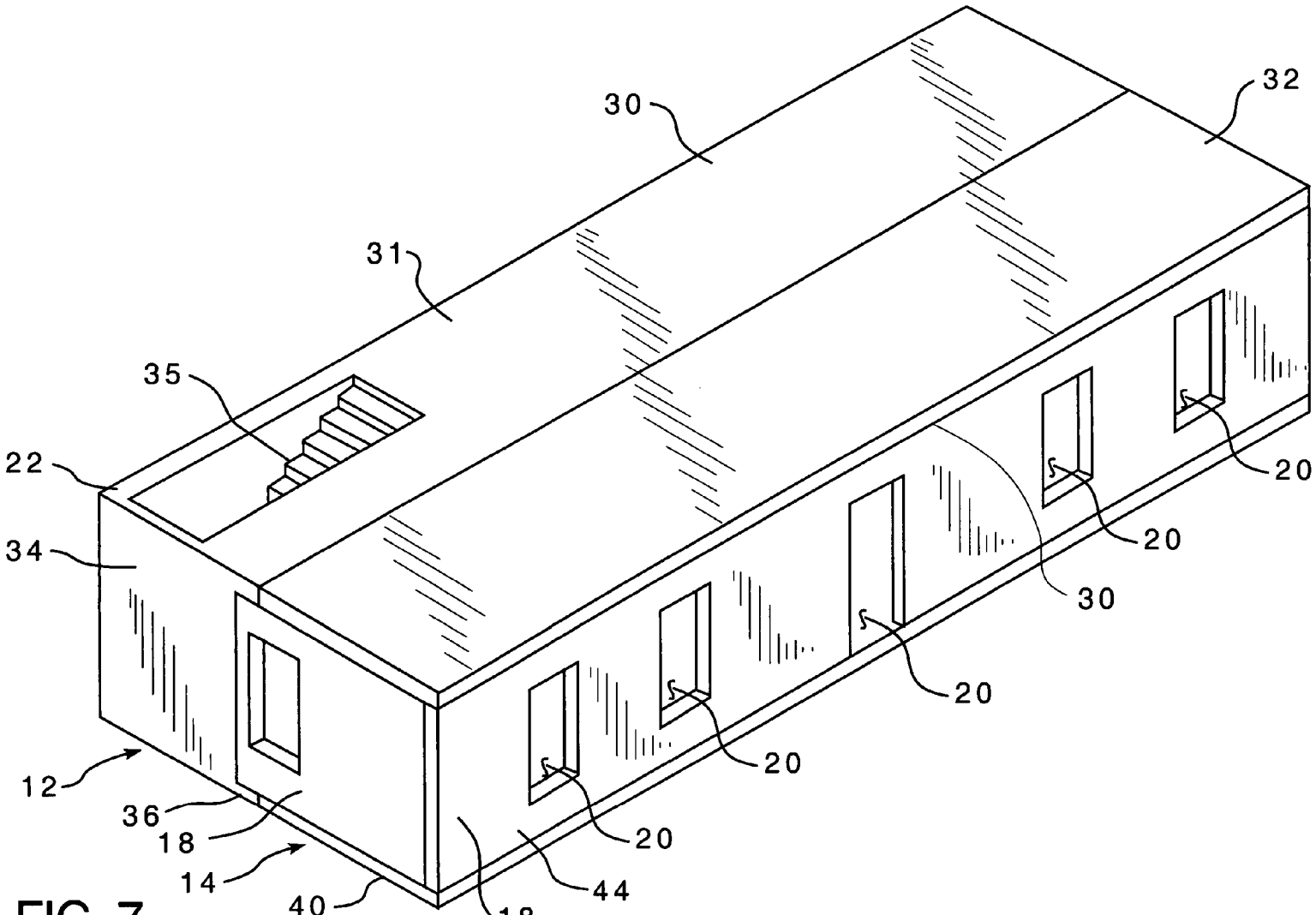
FIG. 7 is an isometric view of a module in the second, open position.

In the preferred embodiment the prefabricated house 3 includes two core modules 11 which are subsequently divided into room functionalities. Additionally, whereas the prior art prefabricated homes typically had a roof panel that included a finished pitch roof with the roof panel opening in excess of about 90 degrees, as shown in FIG. 7, the preferred embodiment includes an interior flat roof 30. The interior flat roof 30 may include a first roof panel 31 and a second roof panel 32 (shown in ghost on FIG. 3, and removed for clarity on FIGS. 4-6). The first roof panel 31 may be integrated into the fixed space portion 12. The second roof panel 32 is a separate structure that is joined to the core module 11. The second roof panel 32 opens only to about 90 degrees, within a 5 degrees reasonable tolerance either side relative to the hinged walls 38 (described below).

FIGS. 3-7 show the method in which the passive space portion 14 of a core module 11 unfolds. Note, all foldable panels 18 open to 90 degrees plus or minus a manufacturing tolerance of 5 degrees. The foldable panels 18 may be rigid or have multiple sub-panels pivotally connected in an accordian-like manner. As shown in FIG. 3, the core module 11 is in a first, closed position. That is, the foldable panels 18 are each in the first, closed position. The fixed space portion 12 includes, in addition to the first roof panel 31, a plurality of fixed walls 34 (FIG. 4), a stair case 35, and a floor 36. The passive space portion 14 includes a plurality of foldable panels 18 that include, but are not limited to, hinged walls 38, a floor panel 40, and multi-function walls 42 (detailed below). The foldable panels 18, while in the first, folded position have, essentially, collapsed the passive space.

Figure 20:
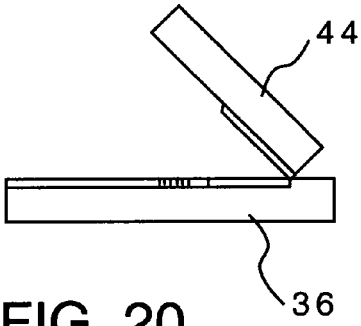
FIG. 20 is a schematic side view of a floor panel and a wall panel with a hinge.

As shown in FIG. 4, the passive space portion floor panel 40 has been rotated about 90 degrees to be generally horizontal and substantially planar with the fixed portion floor panel 36. In FIG. 5, a longitudinal wall panel 44 has been rotated to be generally vertical and substantially parallel to the fixed portion walls 34. In FIG. 6, the foldable panels 18 that are the passive portion hinged walls 38 have been moved into the second, open position. In FIG. 7, the passive portion second roof panel 32 has been moved into the final position which is substantially co-planar with the fixed portion first roof panel 31. Thus, the compressed, passive space portion 14 has been expanded into a useable space. The foldable panels 18 may be coupled to the frame 22 or other components of the fixed space portion 12 by hinges 133 (FIG. 20). The hinges 133 may be mechanical hinges or flexible hinges, surface mounted or recessed, and including, but not limited to, metal, plastic, leather, ferrous or non ferrous material. The second roof panel 32 may be hinged or be disjointed and slid into position.

The longitudinal wall panel 44 may unfold with one of the hinges described above. In a preferred embodiment, the longitudinal wall panel 44 also displaces itself approximately a wall width, about 5 inches to 10 inches. The displacement can be achieved with a hinge structured to produce a linear slide and radial rotation, or a radial rotation and linear slide. Alternatively, a cammed hinge, a hinge that rotates open in a non-radial orbit, or a leash hinge which has no prescribed arc but limits total movement, may be used.

Notwithstanding the above, any of the foldable panels 18 may open with any form of hinge as described above in any combination of materials as cited above. Additionally, the above foldable panels 18 may not be hinged and may be erected loosely as in any other construction using but not limited to welding, screwing, bolting, nailing, use of adhesives, or any combination thereof in any combination of materials.

In the preferred embodiment, the longitudinal wall panel 44 is no longer than the passive portion floor panel 40 by a margin more than about twice a typical wall width. The passive portion hinged walls 38 should not exceed, in any dimension, the shortest floor dimension of passive portion floor panel 40 by more than a factor of 28 percent. Each foldable panel 18 may be sheathed in protective film during production. The protective film remains in place until the module 10 is at the job site, and may be removed anytime thereafter. In the preferred embodiment the protective film remains in place until after the completion of erection, site work and all trade egress.

Figure 8:
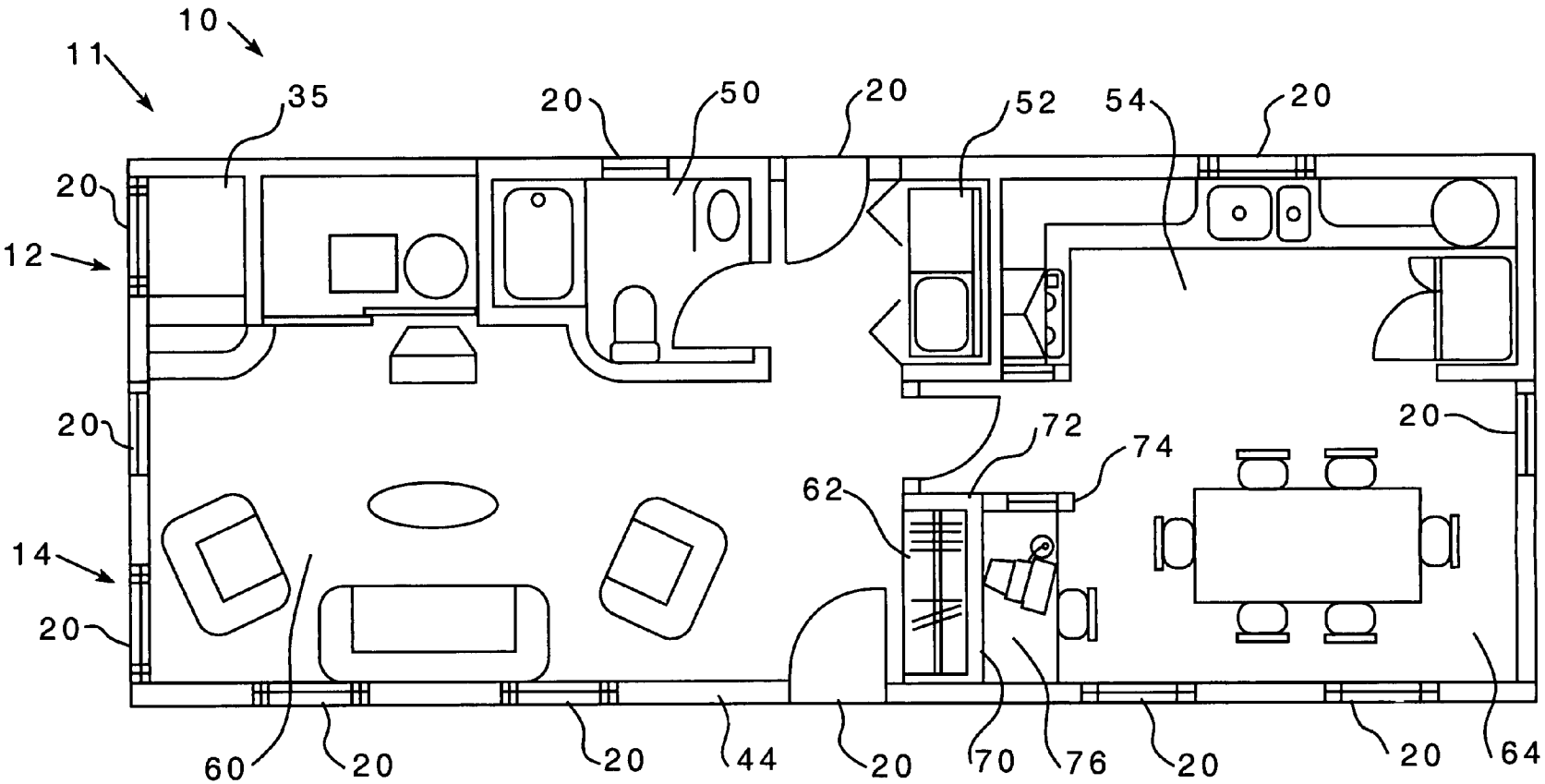
FIG. 8 is a top view of a module in the second, open position.

As shown in FIG. 8, when the core module 11 is expanded, the fixed space portion 12 includes a staircase 35, a bathroom area 50, a laundry area 52, and a kitchen area 54. These areas are disposed in the fixed space portion 12 because certain sub-components, e.g., a bath tub, plumbing, or countertops are substantially rigid and difficult to compress. Conversely, the passive space portion 14 includes a living room area 60, a storage area 62, and a dining area 64. These areas are, by and large, empty until filled with furniture and are easily compressed.

In a further embodiment, as shown in FIG. 8, some minor but practical and mechanically novel efficiencies may be attained by multifunction walls 70. A multi-function wall 70 includes additional foldable panels 18 that may expand beyond a simple flat wall. As shown, the multifunction wall 70 includes a U-shaped portion 72 structured to be used as a closet, and back wall 74, that may, for example, support a computer hutch 76. Different functionalities notwithstanding, in this preferred embodiment this center wall partition performs quadruple duty as partition, doorway/door, entry closet and organizer computer hutch. A further use of multifunction walls 70 is any function of mechanically advantageous detail than can be designed and engineered to be built to provide user functionality between typical stud walls. During shipping, multifunction walls 70 are structured to fold into substantially open spaces in the fixed space portion 12, such as the kitchen area 54.

Figures 9A, 9B, 9C, 9D, 9E, 9F, 9G, 9H, 9I, 9J, 9K:
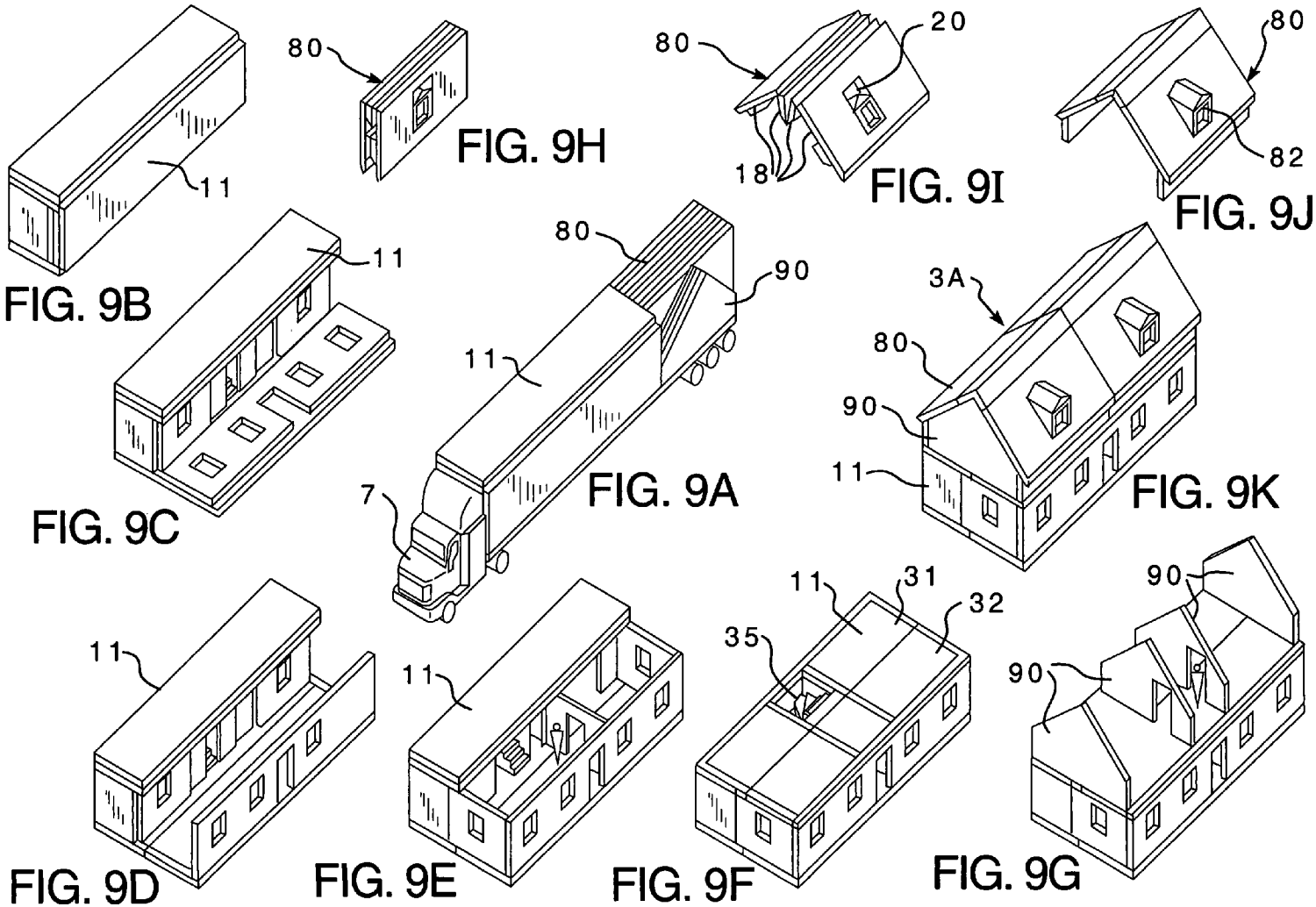
FIGS. 9A-9K show the stages of construction of a prefabricated house system assembled from a series of modules.

As noted above, a core module 11 by itself is not a complete house or building but must be adjoined to other modules 10 in the system for completion. FIGS. 9A-9K show the stages of constructing a substantially complete prefabricated house 3 comprised of two modules 10, a core module 11 and a roof module 80, as well as roof supports 90. FIG. 9A shows the prefabricated house 3 on a truck 7. FIGS. 9B-9F show the expansion of the core module 11 from the first, closed position to the second open position as described above in relation to FIGS. 3-7. As shown in FIG. 9G, the roof supports 90 are coupled to the core module 11 above the first and second roof panels 31, 32. As shown in FIGS. 9H-9J, the roof module 80 includes a plurality of foldable panels 18 and at least one multi-frame opening 20. The roof module 80 is shown in a first, closed position in FIG. 9H, an intermediate position in FIG. 9I, and a second, open position in FIG. 9J. The roof module 80 is coupled to the core module 11 and roof supports 90 as shown in FIG. 9K to form the smaller prefabricated house 3A. FIG. 9F shows the core module 11 with a center staircase 35 to accommodate simpler unfinished second floors as opposed to the finished embodiment shown, for example, in FIG. 7.

Figure 10:
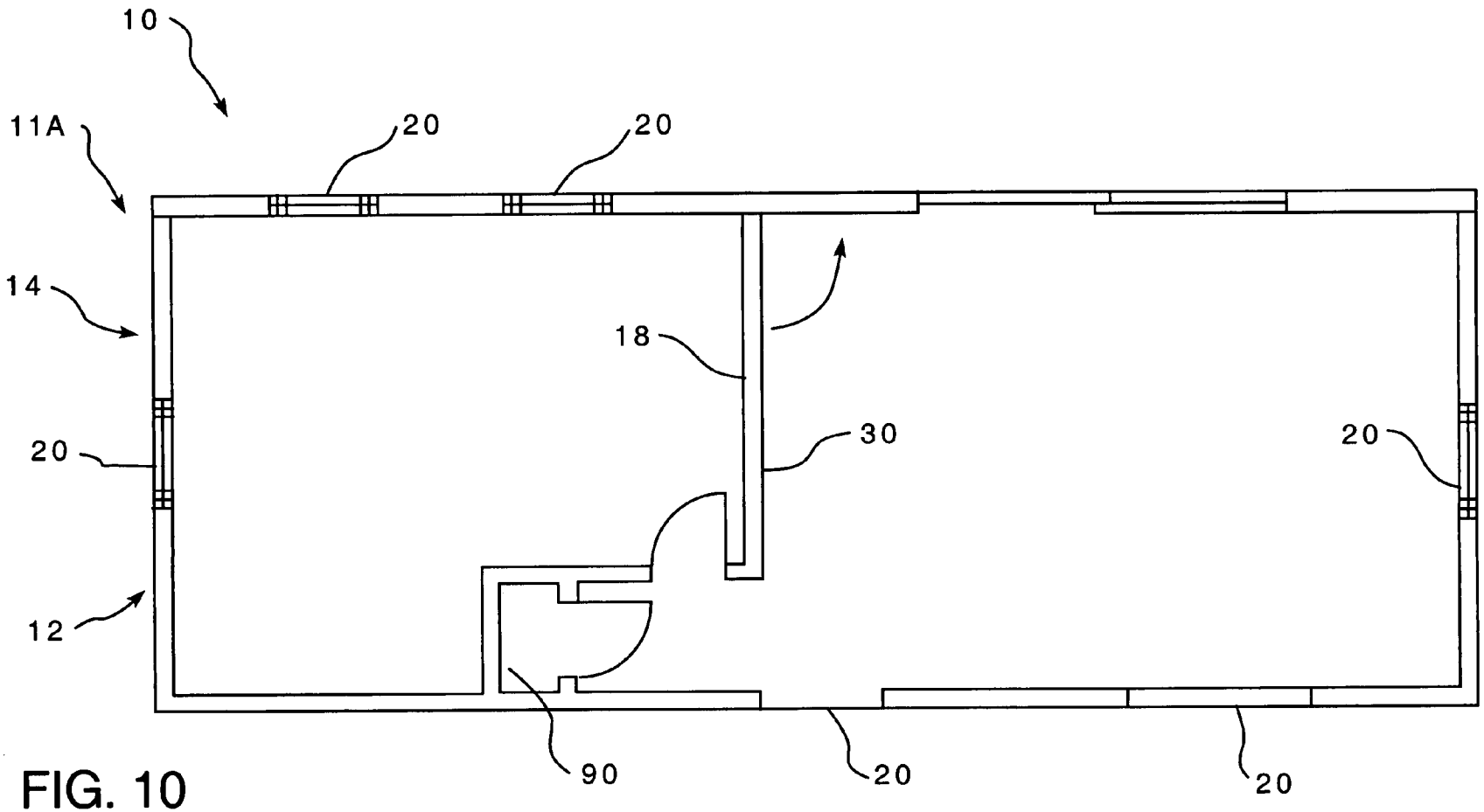
FIG. 10 is a floor plan view of an alternate core module.

As shown in FIG. 10, an alternative core module 11A utilizes all of the practical novelty above yet removes the fixtures from within the fixed space portion 12. In the alternative core module 11A, the fixed space portion 12 includes a rigid storage area 62. The passive space portion 14 may include a single foldable panel 18 that is a hinged wall 38. Thus, when the alternate core module 11A is expanded, the openable volume can reach 66 foot×25 foot×10 foot (interior) and may be used for, but not limited to, great rooms, conference, halls, studios, garages (no floor) or other functionalities.

Figure 11:
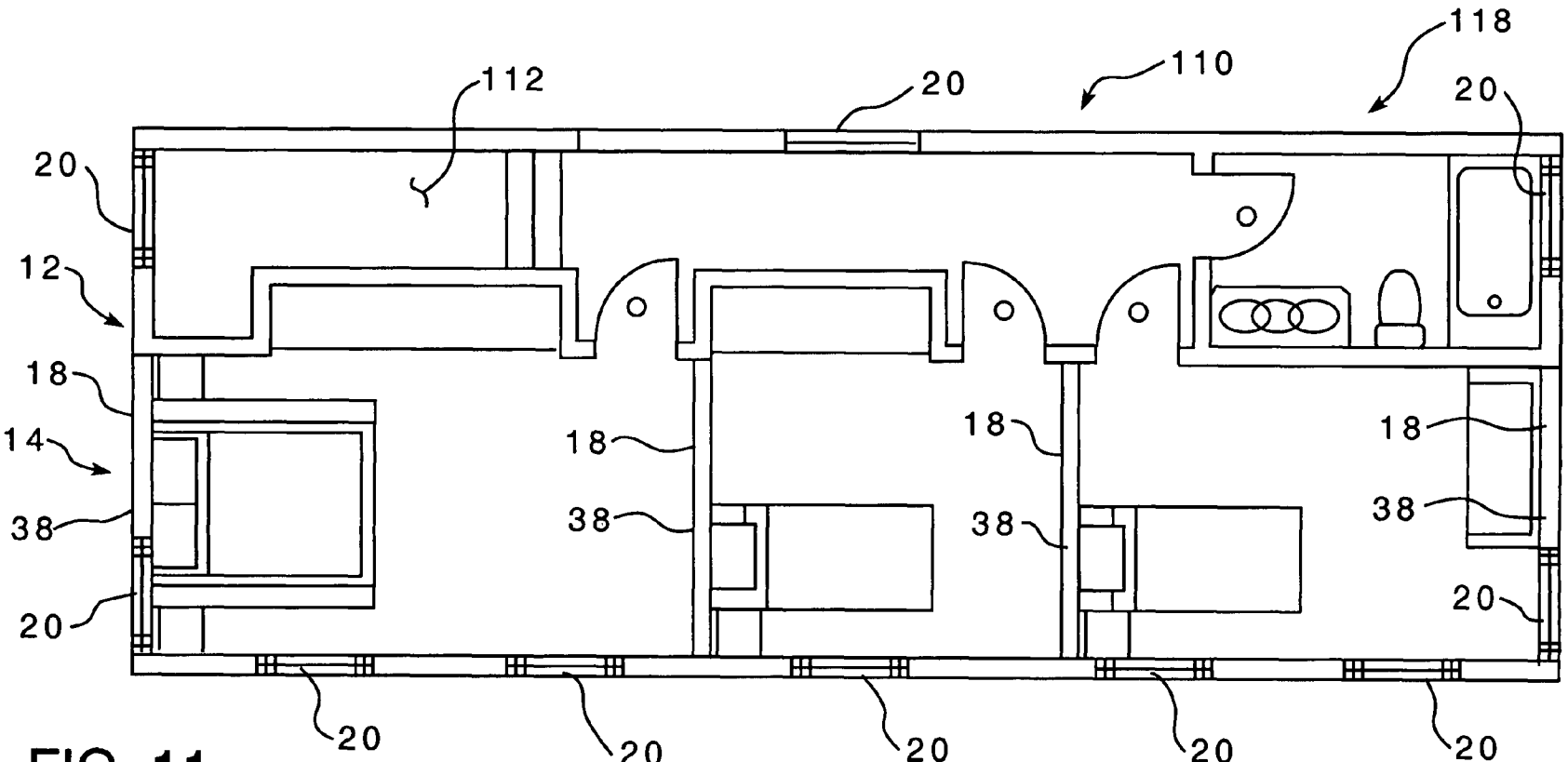
FIG. 11 is a floor plan view of an alternate core module.

As shown in FIG. 11, another alternative core module 11B is structured as a second floor bedroom module 110. Again, the alternative core module 11B includes a fixed space portion 12, that includes an opening for a stair well 112, a hallway 114 and a bathroom 116, as well as a passive space portion 14 having a plurality of foldable panels 18, in this instance hinged walls 38. When the hinged walls 38 are moved into the second, open position as shown in FIG. 11, a plurality of rooms are formed. While the rooms may serve any purpose, the rooms are sized to be bedrooms 118. As an example of the flexibility of the prefabricated house system 1, it is noted that the alternative core module 11B may be coupled on top of the core module 11 shown in FIG. 7. Alternatively, the core modules 11, 11B may be coupled side by side. To do this, the stairwell opening 112 has a floor installed (not shown) thereby extending the hallway 114. In this configuration, the alternative core module 11B may be coupled to the side of the core module 11 shown in FIG. 7. That is, the alternative core module 11B could be rotated 180 degrees from the orientation shown in FIG. 11, and the multi-frame opening 20 adjacent to the hallway 114 may be coupled to the multi-frame opening 20 in the living room area 60. This functionality is detailed below.

Figure 12B:
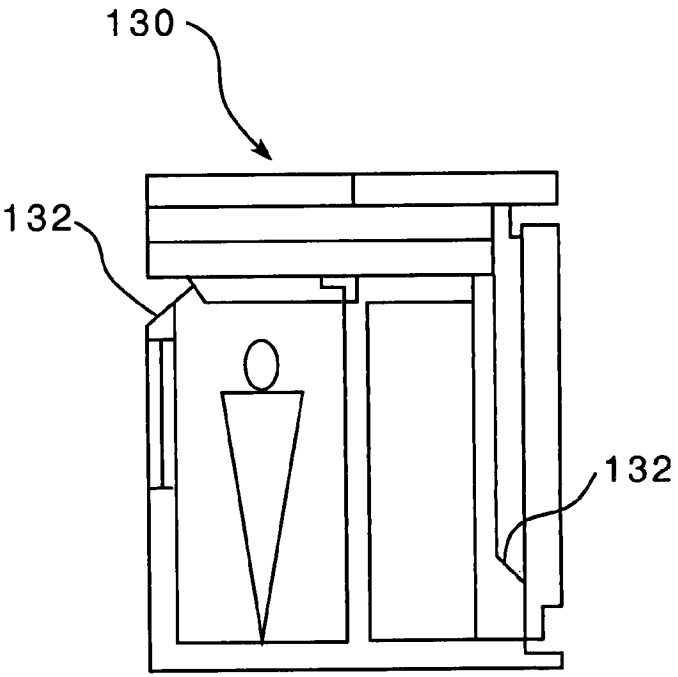
FIG. 12B is a side view of a module with a roof in the first, closed position.
Figure 12A:
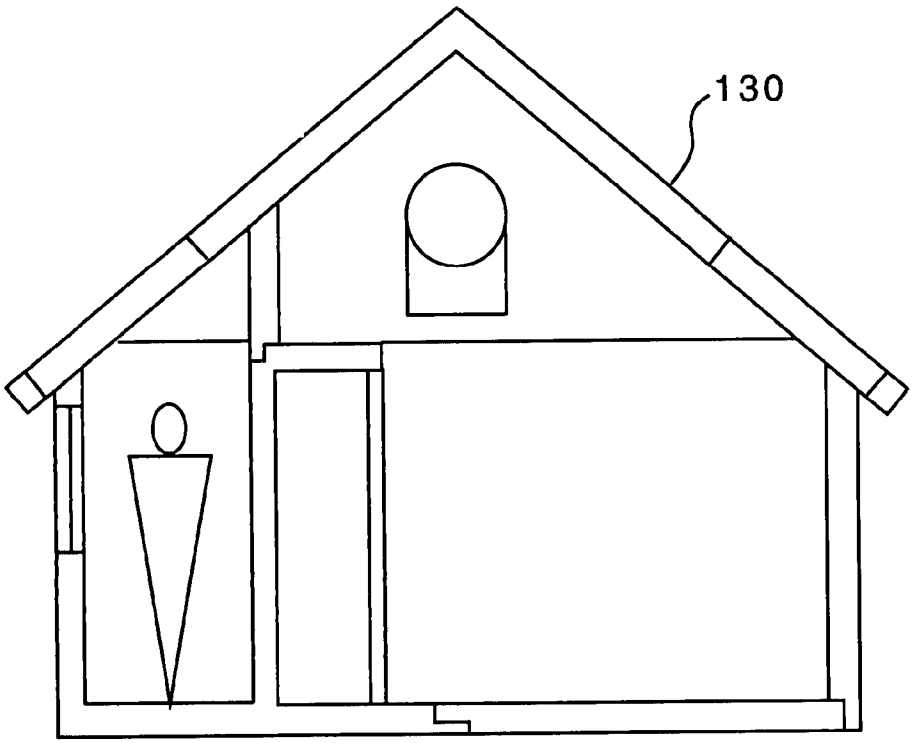
FIG. 12A is a side view of a module with a roof in the second, open position.

The alternative core module 11B may also include a roof section 130, as shown in FIGS. 12A and 12B. The roof section 130, in the closed position is stored in a three-section panel. The front and rear longitudinal side walls are chamfer cut 132 and with a lower aspect in regard to their adjoining side wall. Additionally, the alternative core module 11B demonstrates an alternate and preferred miter hinge design 134 whereby a lap joint with overlap is created via the simple expedient of a detail saw cut, evidenced in other hinges on this floor plan as well, mechanically stronger and a better design to prevent water, wind and weather ingress, and HVAC egress.

Connectivity of the adjacent modules 10 is accomplished by the multi-framed openings 20. Multi-frame openings 20 are the frames within the modules 10 that may or may not be visible from the exterior/interior of the module 10. That is the multi-frame opening 20 may be disposed within any wall. For example, a gable end wall 91 (FIG. 1A) may appear plain from the inside and out, but in reality a multi-frame opening 20 is hidden within the wall 91 and may be framed to accept a window 84 as shown in FIG. 1. Similarly, a roof panel 81 (FIG. 1A) may appear plain from the inside and out, but in reality is hidden framed to accept an exterior dormer 82 as shown in FIG. 1. A front or rear wall may appear plain but may include multi-frame openings 20 and be conduited with appropriate data or an energy cable to accept a front porch or rear deck. Key windows are multi-framed so that such openings may be used as doorways to additional core modules in larger configurations, but are also framed for other structures, e.g. a fireplace 86 (FIG. 1). The mechanical, marketing, and cost saving advantages of multi-framing are many.

Figure 13:
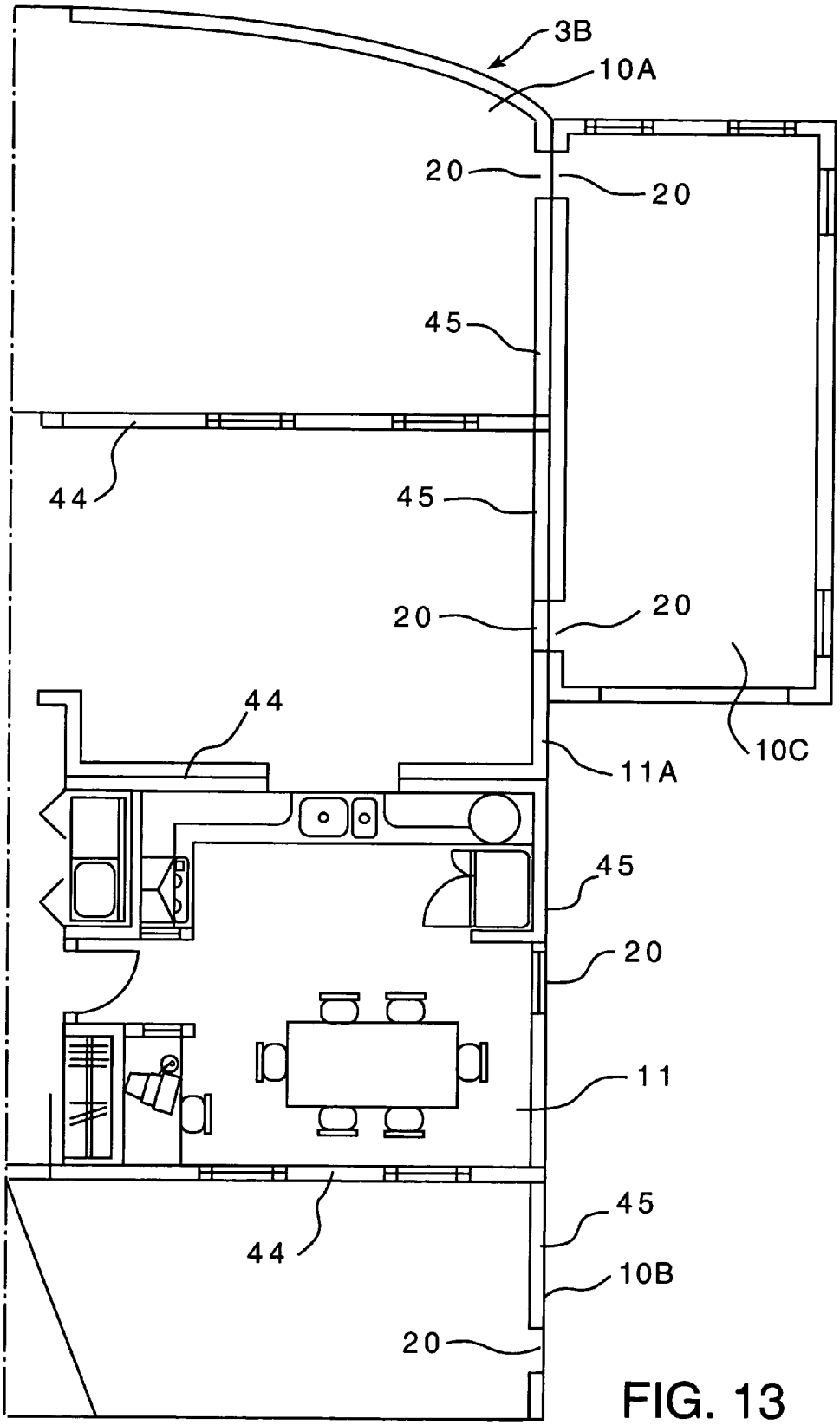
FIG. 13 is a partial floor plan view of a prefabricated house having a spare room attached in one location.
Figure 14:
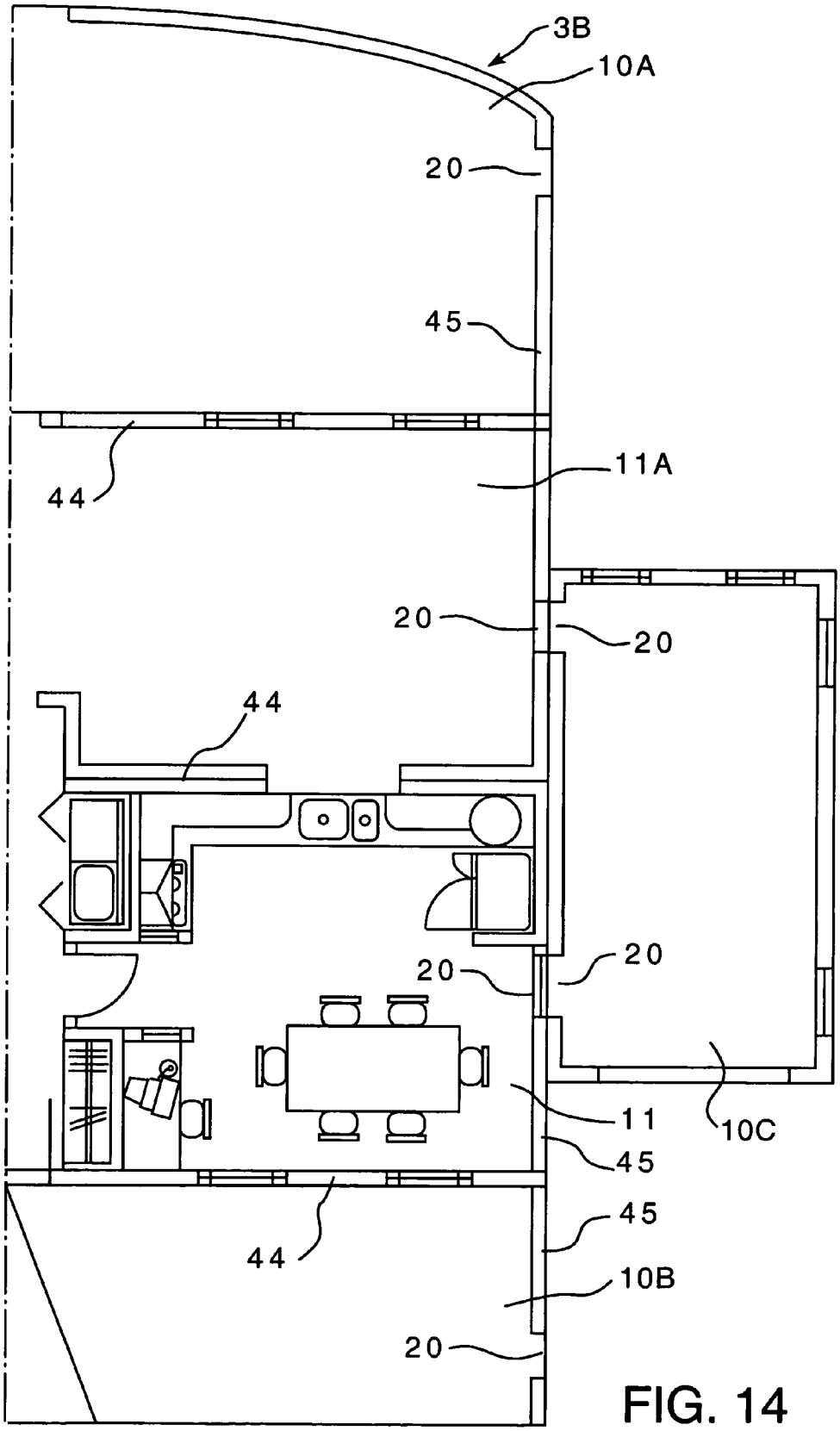
FIG. 14 is a partial floor plan view of a prefabricated house having a spare room attached in another location.
Figure 15:
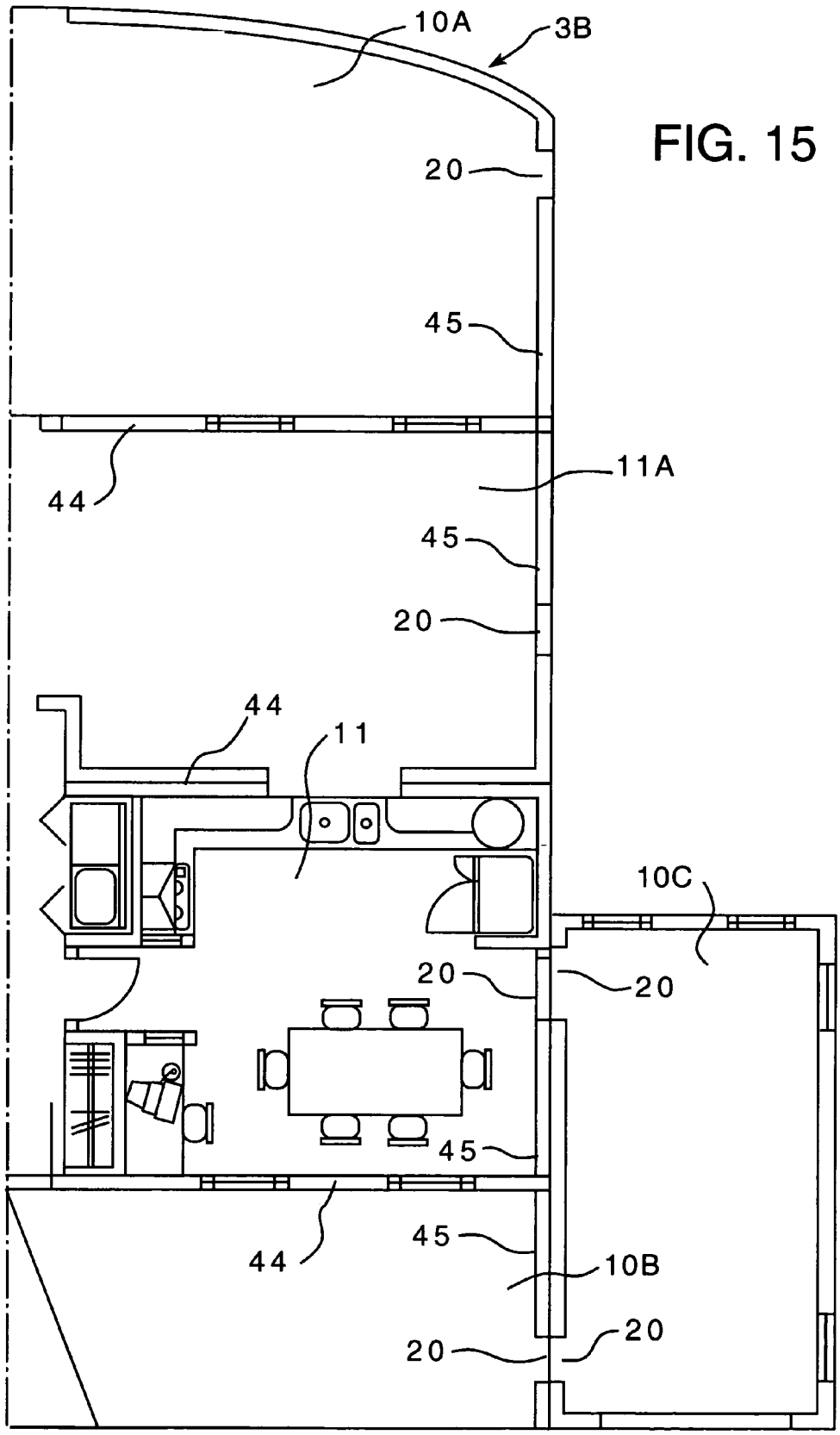
FIG. 15 is a partial floor plan view of a prefabricated house having a spare room attached in another location.

The functionality of multi-frame openings 20 are shown in FIGS. 13-15. In FIG. 13-15 an embodiment of a prefabricated house 3B includes two different core modules 11, 11A, and two other modules, a first additional module 10A and a second additional module 10B. As shown from top to bottom on FIG. 13-15, the modules are coupled along a their respective longitudinal wall panels 44 in a series as follows; the first additional module 10A is coupled to the alternative core module 11A, which is further coupled to the core module 11, which is further coupled to the second additional module 10B. Each of the different core modules 11, 11A, and first and second additional modules 10A, 10B have multi-frame openings 20 along their respective lateral walls 45. A storage room module 10C having two multi-frame openings 20 is also shown in FIGS. 13-15. The storage room module 10C is shown for the sake of this example, but any other module 10 having two or more multi-frame openings 20 may be used as well.

As shown in FIG. 13, the storage room module 10C is coupled to both the first additional module 10A and the alternative core module 11A. As shown, the multi-frame openings 20 on the storage room module 10C and on the first additional module 10A and the alternative core module 11A are aligned. Thus, these multi-frame openings 20 may be converted to doors, thereby providing access between the first additional module 10A, the alternative core module 11A and the storage room module 10C. The multi-frame openings 20 on the core module 11 and the second additional module 10B may either be covered with dry wall 19 or used as windows 84.

Another person, however, may wish to have a similar prefabricated house 3B, but with the same sized storage room module 10C coupled to different modules 10. Thus, as shown in FIG. 14, the storage room module 10C is coupled to the alternative core module 11A and the core module 11. Because the multi-framed openings 20 are distributed in a predetermined mathematical pattern, the multi-frame openings 20 on the storage room module 10C are also aligned with the multi-frame openings 20 on the alternative core module 11A and the core module 11. Similarly, as shown in FIG. 15, yet another person may wish the storage room module 10C to be coupled to the core module 11 and the second additional module 10B. Again, the multi-frame openings 20 of each module align with each other. When a multi-frame opening 20 is not aligned with another multi-frame opening 20 on another module 10, the unaligned multi-frame opening 20 may remain covered or may be used as a window, or a door to the outside.

Figure 16:
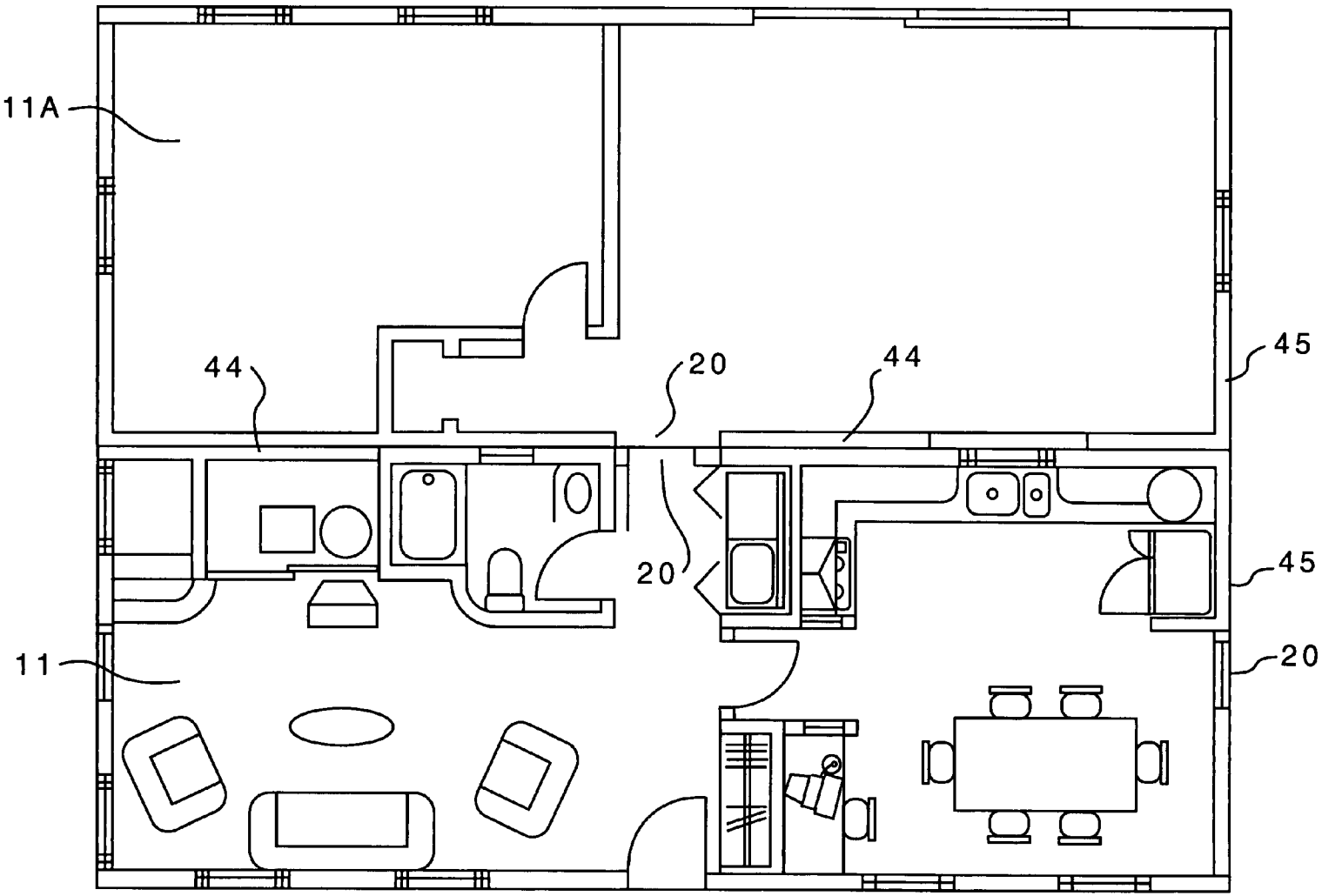
FIG. 16 is a floor plan view of two modules coupled along their longitudinal walls.
Figure 17:
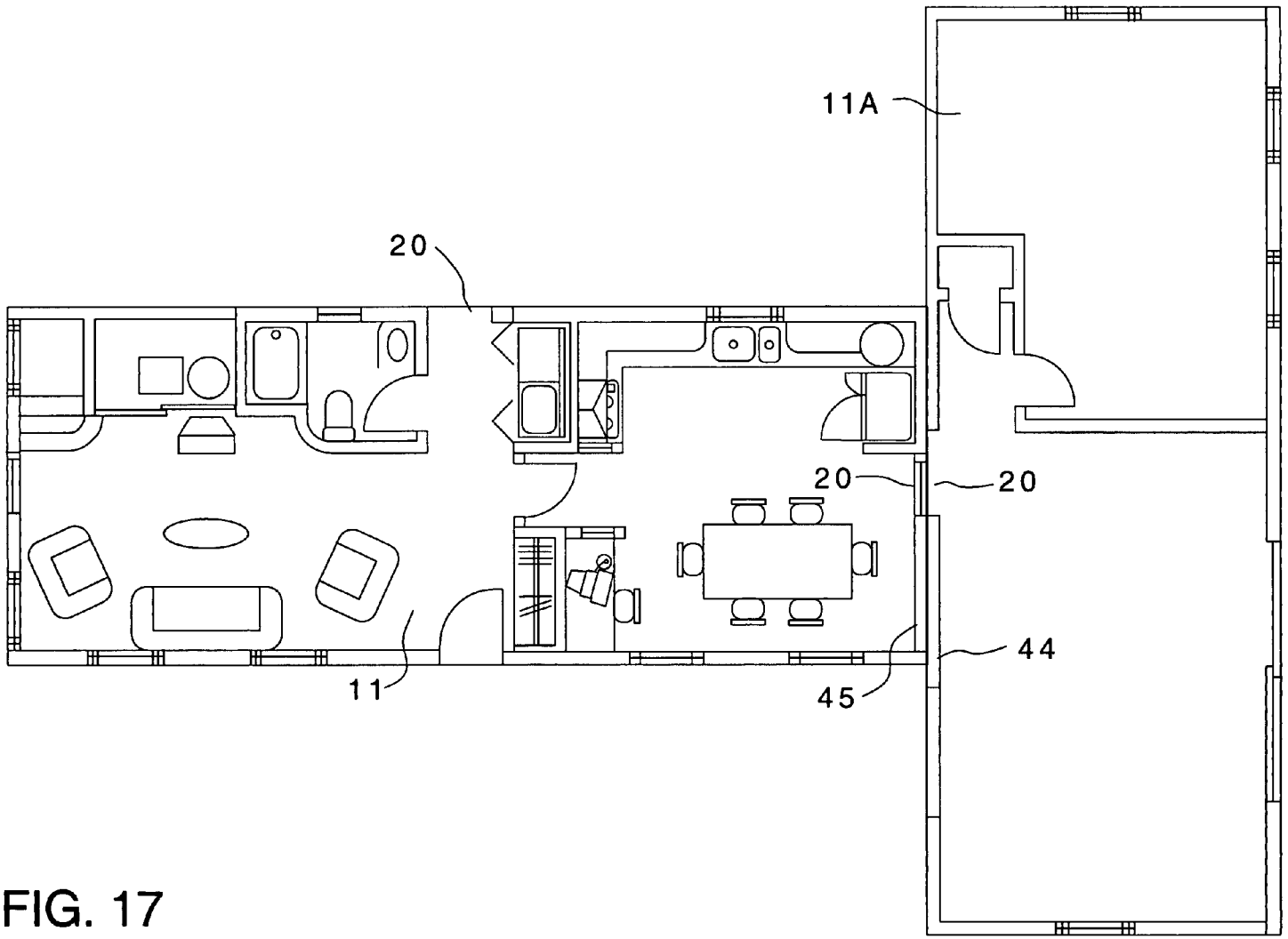
FIG. 17 is a floor plan view of two modules joined together with a longitudinal wall coupled to a lateral wall.

A similar use of modules 10, specifically a core module 11 and alternative core module 11A, each with multi-frame openings 20 is shown in FIGS. 16 and 17. As shown, in FIG. 16, the core module 11 and alternative core module 11A are coupled along their longitudinal walls 44 with the multi-frame opening 20 at about the middle of each longitudinal wall 44 acting as a door. The multi-frame openings 20 along the lateral walls 45 may be covered, act as windows, or as doors to the outside. In FIG. 17, the lateral wall 45 of the core module 11 is coupled to the longitudinal wall 44 of the alternative core module 11A. Thus, the multi-frame opening 20 on the lateral wall 45 of the core module 11 and the multi-frame opening 20 on the longitudinal wall panel 44 of the alternative core module 11A act as doors. Thus, it can be seen that the use of multi-frame openings 20 allow the modules 10 to be disposed in different configurations relative to each other to please various customers, while be manufactured in an efficient, identical manner.

Other elements and details enhance the functionality and manufacturability of the prefabricated house 3 and modules 10. It is well-known that even a more modest double wide house still requires a substantial amount of work prior to completion after it arrives on the building site. For example, walls must be opened, refinished painted, spackled, carpets need to be installed, doorways require a tremendous amount of finish, as do many mating surfaces. It is the function of the preferred embodiment to eliminate the majority of on-site finishing by pre-organizing, or finishing many items at the factory. Through this end it is the intention that the total assets embodied within the invention, will so lower site work that there will be little time or money required for final hook up repair and clean up, a substantial and many times hidden cost in the industry.

Figure 18:
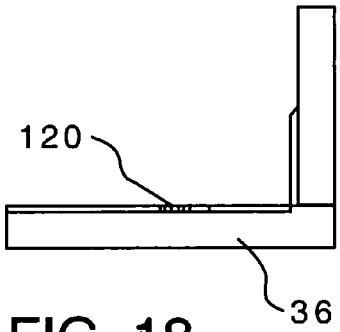
FIG. 18 is a schematic side view of a floor panel and a wall panel.
Figure 19:
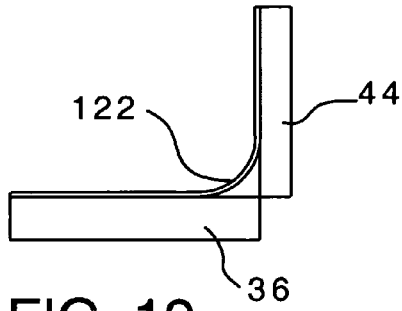
FIG. 19 is a schematic side view of a floor panel and a wall panel with a pipe to assist in preventing a crease in a covering when the panels are in the first, folded position.

For example, as shown in FIG. 18, a floor panel 36 includes a recess 120 structured to accommodate carpeting. As such, carpet is pre-installed where required in combination within the exact layout of foldable panels 18. The entire carpeted floor area is recessed in the floor between ⅛ inch and one inch depending on carpet to ensure that any foldable panels 18 do not bind. Foldable panels 18 may have wheels at their lowest lead sweeping corner to aid in opening. As shown in FIG. 19, where a floor panel is folded back upon itself, a pipe 122 of appropriate diameter and material may be placed at the internal crease of the carpet so as to prevent permanent creasing during manufacture, storage and shipping.

Figure 21:
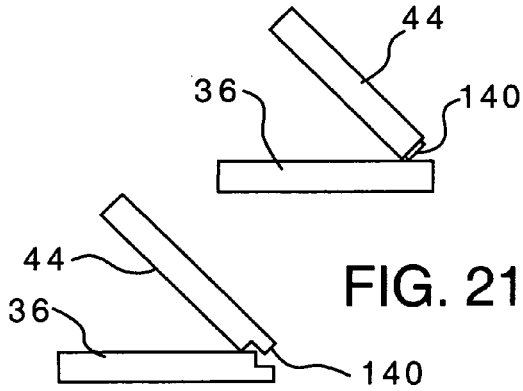
FIG. 21 is a schematic side view of a floor panel and a wall panel with insulation therebetween.

Floor molding tends to be in compactable structure. In the preferred embodiment the hinge 133, described previously, has its true radial center at the bottom of the baseboard trim, as shown in FIG. 20. As shown in FIG. 21, the joint between a floor panel 36 and a wall panel, e.g., the longitudinal wall panel 44, may further include insulation 140.

Figure 22:
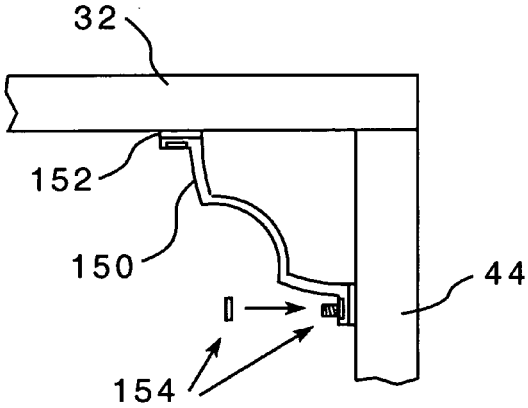
FIG. 22 is a schematic side view of a roof panel and a wall panel.

Another time intensive installation procedure is required for the crown molding. Crown molding is used for the mechanical function of creating a separate air volume for corner area heat insulation. Crown molding as a means covering seams without paint and adding value through better quality. In the prior art, time, labor and cost were increased during the finishing of trim. The problems of finishing are four-fold. First, the trim must be applied normally by tacking into place creating a hole. Second, any small gap creates a thin black gap that the eye is instantly drawn to, so this gap must be caulked, typically in a color that matches neither the wall nor the trim accurately, ruining both. Third, the wall must be repainted at the cornice edge, often resulting in the entire wall being re-painted for practical reasons. Fourth, the cornice must be painted to cover both the tack holes holding it on and to cover the caulk on the trim side. These problems are avoided by the present invention which provides crown molding, shown in FIG. 22, that includes, but not limited to, molding 150 having a color matched gasket 152 at its perimeter molded on, or adhered on subsequent to production. Presuming a commonly used synthetic molding of extruded crown molding, or as a less preferred embodiment, wood. A screw 154 and plug fastening system with a decorative detail that covers the screw, allowing the unit to be pre-colored at the factory, in conjunction with a self-color gasket applied by any conventional means. A similar system is applied to all floor/crown/window/door and surround details including but not limited to any form of interior wall floor or ceiling trim, including wall corner, wall ceiling and wall floor molding, both internal and external to the home.

Figure 23:
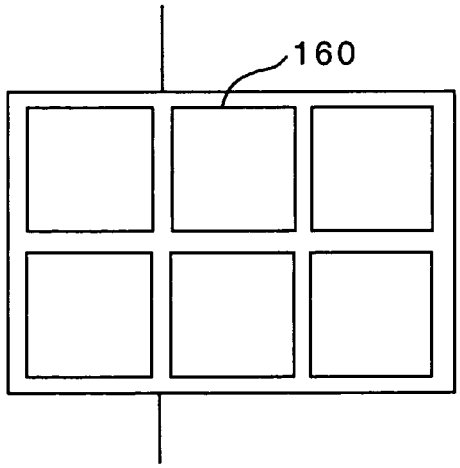
FIG. 23 is a schematic view of a covering for a roof panel.

Another problem in the prior art was painting the visible seam in the roof between ceiling panels. As shown in FIG. 23, this is resolved by applying a decorative grid pattern covering 160 to the ceiling. This covering 160 also called a coffered ceiling and seen as an expensive addition. The covering 160 is inexpensive to install at the factory relative to the alternate (and variable cost) at site work. Using the same technology as the corner molding as a preferred optional but alternately traditional wood or suitable synthetic strips to create the ceiling, the relevant strip which would cover the seam in the ceiling is shipped loose and with the simple install of this one small piece the ceiling is complete without mess. Gasket sealing, in the preferred embodiment, is foreseen in order to build to the widest acceptable tolerances, to lower costs and to improve the speed of production. Gasketing may be installed on all leading edges to be bolted or secured together.

In concert with, or independently of, the preferred embodiment may in addition to the gasket seam have an aligning dove tail, lap joint or any irregular surface to hinder ingress and egress of rain heat, etc. For the purposes of insulation and improved quality and feel, the preferred embodiment may employ a novel foam filling of the back of the vinyl clap board. This is believed to be the best mechanical method to get both a firm feel to the touch like real clapboard, with a minimum of material and have the ancillary but nevertheless valuable benefit of high "r" rated insulation. Corner seam boards, made from extruded vinyl, as a preferred embodiment or alternately cast, natural or any covering board, to cover both vertical and horizontal core module to core module seams, are similar to the interior crown moldings. A variety of exterior finishes both real and composite, including but not limited to clapboard, brick, stucco, limestone, stone may be used.

Figure 24:
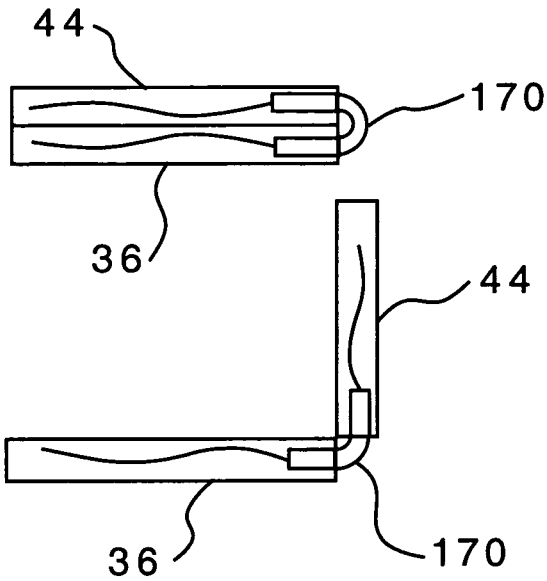
FIG. 24 is a schematic side view of the interior of a floor panel and a wall panel showing the flexible conduit used to protect cabling and vents.

A common problem with any house is that utilities, wiring ducting alarms and others are not complete. This problem is addressed by the present invention via flexible ducting 170 shown in FIG. 24. Using fixed space portions 12 and passive space portions 14 assures that wet and pressure pipes (water and gas) not only run in fixed non movable locations, i.e., the fixed space portion 12, wet and pressure ducting is considered too dangerous or leak prone to run through flexible conduits. The remaining wire and air conduits, typically include but are not limited to: electricity, cable, phone, computer network cables and other assorted electronic wiring as well as forced air both hot and cold, are free to run through the passive fold down spaces via the fold down walls with a couple of safety provisions. For air, a simple flexible ducting 170 is employed between the two rigid members in the wall. The flexible ducting 170 is of a profile including but not limited to round and durometer (hardness) that it resists flexing or is built to resist flexing by some other means, including but not limited to a steel coil, for example.

Figure 25:
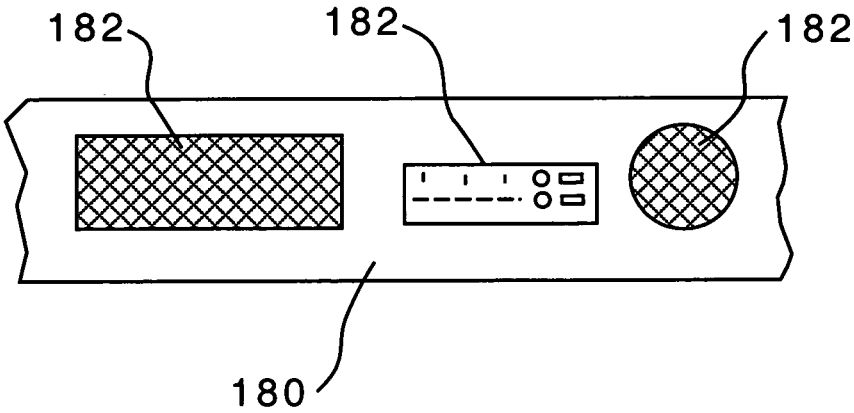
FIG. 25 is a schematic side view of a baseboard with multiple outlets.

For air conduits, there may be excess conduit when a foldable wall is in the closed position. To accommodate the extra length, the conduit resides within about 16 inches on center frame lumber or steel of the interior wall. For wire cabling, the cabling is simply routed through a flexible ducting 170 as is used for air with the same desirous result. In a preferred embodiment, access to the services provided by the various conduited walls can be via outlets 182 affixed to recess in the baseboard 180, whether they be vent grills, electrical outlets or computer cabling, see FIG. 25, including sound/surround sound, etc. Notwithstanding the above, all wire and air may also be routed routinely if desired to emerge from the floor using the flexible non-crushable conduit connector, for example, it is oftentimes where there is a coffee table in the middle of the room where a telephone might reside but for a telephone wire. Using these elements, the modules include substantially finished trim.

As shown in FIG. 1, the modules may also include a deck and/or porch modules 10D, 10E, which may also be folded. The folded deck module 10D and exterior surfaces, specifically the front porch module 10E, rear porch and second story balistrading are structured to be coupled to other modules 10 of the prefabricated house system 1 at standardized connection points. Standardization of connection points allows for standardization of decks, porches or similar outdoor structures, which in turn allows mass production, which in turn of course enables mass production and all related savings. The invention of a standardized building system that builds flexible prefabricated houses 3, 3A designs allows decks to be manufactures in a factory, with the innovative step of applying hinges folded flat and shipped cost effectively. Exterior modules 10 may include, but are not limited to, a fold down front porch 10E, a fold down front porch with roof, a fold down front porch with roof and screens, a fold down front porch with roof and glass or any combination of the above with any combination of, cabling for electrical, sound, bug zappers, lights and bar-b-q. All decks include multi-framed openings 20 so that the deck may be coupled to the housing modules. Similarly, a fold down rear deck module 10D, in any number of practical sizes and plan view silhouette, including but not limited to straight curved wavy etc., with or without any combination of: cabling for electrical, sound, bug zappers, lights and bar b q. may be multi-framed to be attached to an existing house 3.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A prefabricated house comprising:

two or more modules each module having a frame, said frame having a plurality of studs;

said module frames having one or more multiframe openings;

each said multiframe opening incorporating two studs from said module frame plurality of studs and having a plurality of medial cross-members;

said two or more modules structured to be joined at one of said one or more multi-frame openings;

wherein each cross-member in said plurality of cross-members is coupled to said studs in a manner sufficient to support any additional components selected from the group including: doors windows, fireplaces or dormers; and wherein each cross-member in said plurality of cross-members is removably coupled to said studs.

2. A prefabricated house comprising:

two or more modules, each module having a frame, said frame having a plurality of studs;

said module frames having one or more multiframe openings;

each said multiframe opening incorporating two studs from said module frame plurality of studs and having a plurality of medial cross-members;

said two or more modules structured to be joined at one of said one or more multi-frame openings; and wherein each cross-member in said plurality of cross-members is removably coupled to said studs.

3. A prefabricated house comprising:

two or more modules, each module having a frame, said frame having a plurality of studs;

said module frames having one or more multiframe openings;

each said multiframe opening incorporating two studs from said module frame plurality of studs and having a plurality of medial cross-members;

said two or more modules structured to be joined at one of said one or more multi-frame openings;

wherein said modules include one or more foldable panels;

at least one of said two or more modules is a core module having a fixed space portion and a passive space portion;

said fixed space portion having non-foldable walls;

said passive space portion having said foldable panels;

said foldable panels movable from a first, closed position to second open position;

wherein said core module has dimensions of less than about 66 feet, by 10 feet, by 12 feet when said foldable panels are in said first position;

wherein said modules may be joined at said multi-frame openings with said modules disposed in more than one configuration relative to each other;

said multi-frame openings are enclosed within a covering over said module frame;

said multi-frame openings are structured to be converted into openings;

wherein each cross-member in said plurality of cross-members is coupled to said studs in a manner sufficient to support any additional components selected from the group including: doors, windows, fireplaces or dormers; and wherein each cross-member in said plurality of cross-members is removably coupled to said studs.

4. A prefabricated house comprising:

two or more modules, each module having a frame, said frame having a plurality of studs;

said module frames having one or more multiframe openings;

each said multiframe opening incorporating two studs from said module frame plurality of studs and having a plurality of medial cross-members;

said two or more modules structured to be joined at one of said one or more multi-frame openings;

wherein said modules include one or more foldable panels;

at least one of said two or more modules is a core module having a fixed space portion and a passive space portion;

said fixed space portion having non-foldable walls;

said passive space portion haying said foldable panels;

said foldable panels movable from a first, closed position to second open position;

wherein said core module has dimensions of less than about 66 feet, by 10 feet, by 12 feet when said foldable panels are in said first position;

wherein said modules may be joined at said multi-frame openings with said modules disposed in more than one configuration relative to each other;

said multi-frame openings are enclosed within a covering over said module frame;

said multi-frame openings are structured to be convened into openings; and wherein each cross-member in said plurality of cross-members is removably coupled to said studs.

* * * * *

UNITED STATES PATENT AND TRADEMARK OFFICE

CERTIFICATE OF CORRECTION

PATENT NO. : 8,474,194 B2
APPLICATION NO. : 10/653523
DATED : July 2, 2013
INVENTOR(S) : Tiramani It is certified that error appears in the above-identified patent and that said Letters Patent is hereby corrected as shown below:

In the claims
Column 12, line 59, Claim 1, “modules each” should read --modules, each--.
Column 13, line 4, Claim 1, “doors windows,” should read --doors, windows,--.
Column 14, line 26, Claim 4, “haying” should read --having--.
Column 14, line 37, Claim 4, “convened” should read --converted--.

Signed and Sealed this
Third Day of November, 2015

Michelle K. Lee

Michelle K. Lee
*Director of the United States Patent and Trademark Office*